US006330414B1

(12) United States Patent
Takuma et al.

(10) Patent No.: US 6,330,414 B1
(45) Date of Patent: Dec. 11, 2001

(54) DEVELOPING SYSTEM HAVING A PLURALITY OF DEVELOPING ROLLERS WITH OPPOSING MAGNETS OF SAME POLARITY

(75) Inventors: Yasuo Takuma, Hitachi; Yoshitaka Fujinuma; Tomonari Hokkyou, both of Hitachinaka; Masayasu Anzai, Hitachi; Koji Kato, Hitachinaka, all of (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/409,079

(22) Filed: Sep. 30, 1999

(30) Foreign Application Priority Data

Sep. 30, 1998 (JP) ..... 10-277812
Feb. 5, 1999 (JP) ..... 11-028272

(51) Int. Cl.[7] ..... G03G 15/08
(52) U.S. Cl. ..... 399/267; 399/272; 399/281
(58) Field of Search ..... 399/267, 272, 399/273, 274, 275, 277, 269

(56) References Cited

U.S. PATENT DOCUMENTS 4,041,903 * 8/1977 Katakura et al. ..... 399/273
5,416,571 * 5/1995 Yamada et al. ..... 399/272 X
5,516,982 * 5/1996 Takeuchi et al. ..... 399/274
5,557,371 * 9/1996 Tooda ..... 399/279 X
5,630,201 * 5/1997 Suzuki et al. ..... 399/269
5,995,790 * 11/1999 Takeda ..... 399/274

FOREIGN PATENT DOCUMENTS 58-142358 * 8/1983 (JP) .

* cited by examiner

*Primary Examiner*—Quana M. Grainger
(74) *Attorney, Agent, or Firm*—Antonelli, Terry, Stout & Kraus, LLP

(57) ABSTRACT

In a developing system containing a combination of forward-rotating and a backward-rotating developing rollers, a steady quantity of developing agent should be supplied to the developing rollers for high-quality printed images. This requirement can be satisfied by placing a doctor blade between an intersection point, where a line connecting the central axis of one of the developing rollers and its polarity reversing position meets a line connecting the central axis of the other of the developing rollers and its polarity reversing position, and the developing roller pair. Further, the doctor blade should be located on the upstream side of the developing agent flow relative to the central axes of the backward-rotating developing roller and the forward rotating developing roller with its rightmost side (upstream side) in parallel with the line connecting the central axes of the developing rollers, and the doctor gap (on the side of the developing roller to which the developing agent is supplied) should be greater than a minimum gap (doctor gap) between one end of the doctor blade and the surface of the developing roller to which the developing agent is first supplied.

14 Claims, 18 Drawing Sheets

$$h = \{(D1 + D2)/2 + W\} \sin\theta 1 \sin\theta 2 / \sin(\theta 1 + \theta 2) \quad (1)$$

$$Tmax = h - (D2/2 + G2) \sin\theta 2 \quad (2)$$

$$L = h / \sin\theta 2 - D2/2 \quad (3)$$

$$(0^\circ \leqq \theta < 90^\circ)$$

$$t^2 = \{G1 - (w - d)/2\}\{G1 + (w - d)/2 + D1\} \quad (4)$$

$$\triangle G = G1 - \sqrt{(t - \delta)^2 + \{D1/2 + (w - d)/2\}^2} - D1/2 \quad (5)$$

$$B = \sqrt{(r\,Gdev + D1/2)^2 - (D1/2 + L/2)^2} - (r + Gdev) \qquad (6)$$

$$B = D1 / 4 \qquad (7)$$

DEVELOPING SYSTEM HAVING A PLURALITY OF DEVELOPING ROLLERS WITH OPPOSING MAGNETS OF SAME POLARITY

BACKGROUND OF THE INVENTION

The present invention relates to an image recording system, such as an electrophotographic printer, a copying machine, etc.; and, more particularly, the invention relates to a developing system using magnetic developing agents.

The image recording system, such as used in an electrophotographic printer, a copying machine, etc., forms an electrostatic latent image having a preset potential VR (and the non-image area has a preset potential VO) on an image carrier called a photoconductive drum, which rotates in one direction only. A developing agent called a toner is supplied from a developing unit to the drum to render the latent image visible, and the toner image is then transferred onto recording paper. Conventionally this kind of electrophotographic image recording system mostly employs a developing unit which uses a two component developer containing both a toner and a magnetic powder called a "carrier".

Usually, this kind of developing unit stirs the two component developer in a storage tank. The toner and the carrier in the storage tank vigorously rub against each other and are respectively charged to preset magnitudes. This charged developing agent then is fed from the developing agent tank to the developing means in the form of "developing rollers" each of which carries a plurality of magnets on the circumference thereof. The charged developing agent is attracted to the developing rollers and carried on the surface of the developing rollers.

The developing agent on each developing roller is leveled by a parting plate called a "doctor blade." The polarities of the magnets on the rotational upstream and downstream sides relative to the doctor blade are reversed to increase the transferability of the developing agent on each developing roller.

Next, the developing agent on the developing roller which is leveled by the doctor blade is rotationally carried into contact with the surface of the photoconductive drum. At the same time, a bias potential (hereinafter called a "developing bias") VB is applied to the developing rollers to transfer only toner onto the latent image on the surface of the photoconductive drum. Consequently, the latent image on the photoconductive drum is rendered visible.

There are three ways to make the developing agent on the developing rollers come in contact with the surface of the photoconductive drum: a first way involves rotating the developing roller in the same rotational direction as said photoconductive drum (hereinafter termed "forward rotation") to transfer the developing agent; a second way involves rotating the developing roller in a rotational direction opposite to the direction of rotation of said photoconductive drum (hereinafter termed "backward rotation") to transfer the developing agent; and a third way involves use of both a forward-rotating developing roller and a backward-rotating developing roller to transfer the developing agent.

In the above-mentioned developing techniques, the ratio of the rotational speed of the developing roller to the rotational speed of the photoconductive drum (hereinafter termed "peripheral speed ratio") is generally greater than 1. In the developing system using a two component developer, more particularly, in the developing system having a backward-rotating developing roller on the rotational upstream side of the photoconductive drum, as disclosed in Japanese Non-examined Patent Publication No. 02-8308 (1990), a forward-rotating developing roller on the rotational downstream side, which is very close to the backward-rotating developing roller, and a doctor blade between said developing rollers, the developing agent is transferred in a mass towards the doctor blade, divided into two parts for the two developing rollers by the doctor blade, and then is applied to the developing rollers through a gap between the doctor blade and each developing roller. In this method, the doctor blade is placed with its top edge facing the photoconductive drum (on the downstream side of the developing agent relative to the central axes of the developing rollers). Each end of the base side of the doctor blade and the surface of each developing roller forms a gap into which the developing agent is filled. Consequently, the developing agent has a high bulk density before being conveyed to each of the developing rollers. However, in this case, the excess developing agent which does not go through the doctor gaps remains at the doctor blade in a narrow space between the developing rollers. As a result, the developing agent undergoes unwanted stresses and, consequently, the service life of the developing agent becomes shorter.

A proposed method disclosed in Japanese Non-examined Patent Publication No. 07-160123 (1995) comprises placing the doctor blade further away from the surface of the photoconductive drum (on the upstream side of the developing agent relative to the central axes of the developing rollers) and dividing the flow of the developing agent through these wider doctor gaps.

A method which involves placing the doctor blade on the upstream side of the developing agent relative to the central axes of the developing rollers (further away from the surface of the photoconductive drum) provides a less stable supply of the developing agent to the developing rollers than a method which involves placing the doctor blade on the downstream side of the developing agent relative to the central axes of the developing rollers (nearer to the surface of the photoconductive drum) because the higher filling pressure of the developing agent is not available.

In a developing system in which the front end of said doctor blade is placed on the downstream side of the developing agent relative to a line through the central axes of the developing rollers, the excess developing agent which does not go through the doctor gaps remains at the doctor blade in a narrow space between the developing rollers. As a result, the developing agent undergoes unwanted stresses and, consequently, the service life of the developing agent becomes shorter.

SUMMARY OF THE INVENTION

An object of the present invention is to provide a developing system which uses a developing method in which there is a steady supply of the developing agent, resulting in high-quality images.

Another object of the present invention is to provide a developing system having a doctor blade positioned between a backward-rotating developing roller and a forward rotating developing roller, thereby reducing the stresses on the developing agent and increasing the service life of the developing agent, while also supplying a fixed amount of developing agent steadily to the developing rollers to obtain high-quality images.

The aforesaid problems can be solved by supplying the developing agent to the pair of developing rollers at a position where the polarities of the magnetic poles (different polarities) on the upstream and downstream of said doctor blade are opposite to each other. (Hereinafter, such positioning is termed a "Polarity reversing position.") Further, the aforesaid problems can be solved by placing the doctor blade before an intersection where a line connecting the central axis of one of said developing rollers and its polarity reversing position meets a line connecting the central axis of the other of said developing rollers and its polarity reversing position (on the downstream side in the direction of rotation of said developing roller pair).

The above-discussed problems can be solved by the following three configurations: A first configuration involves placing the doctor blade on the upstream side of the developing agent flow relative to the central axes of the backward-rotating developing roller and the forward rotating developing roller and dividing the developing agent flow towards the developing rollers through wider doctor gaps. A second configuration involves placing the doctor blade with its base side (on the upstream side of the developing agent flow) approximately in parallel with a line connecting the central axes of said developing rollers. A third configuration involves making the doctor gap (on the side of the developing roller to which the developing agent is supplied) greater than a minimum gap (doctor gap) between one end of the doctor blade and the surface of the developing roller to which the developing agent is first supplied.

DETAILED DESCRIPTION OF PREFERRED EMBODIMENTS

Figure 1:
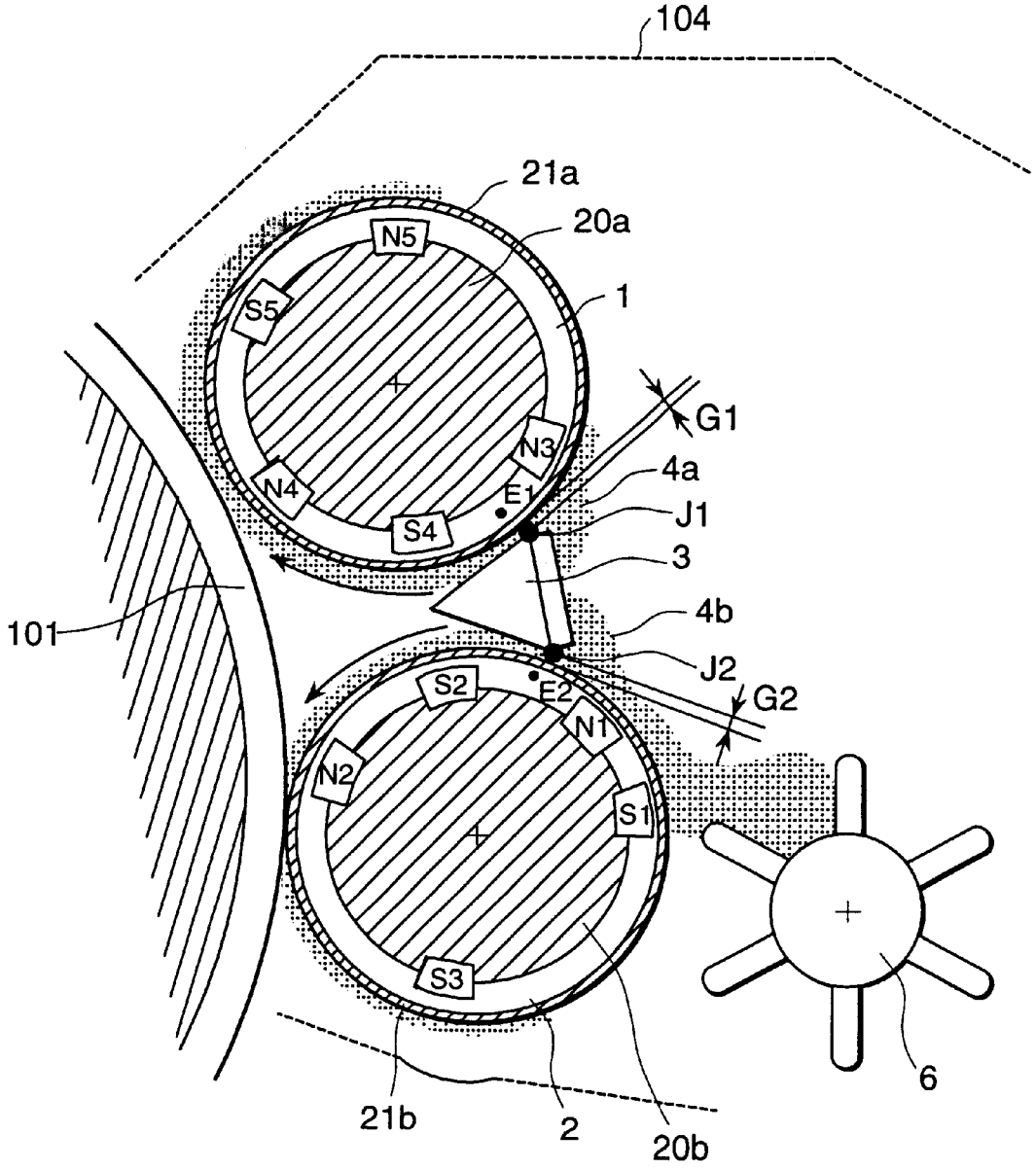
FIG. 1 is a partially-magnified diagrammatic view of a developing system according to a first embodiment of the present invention.
Figure 2:
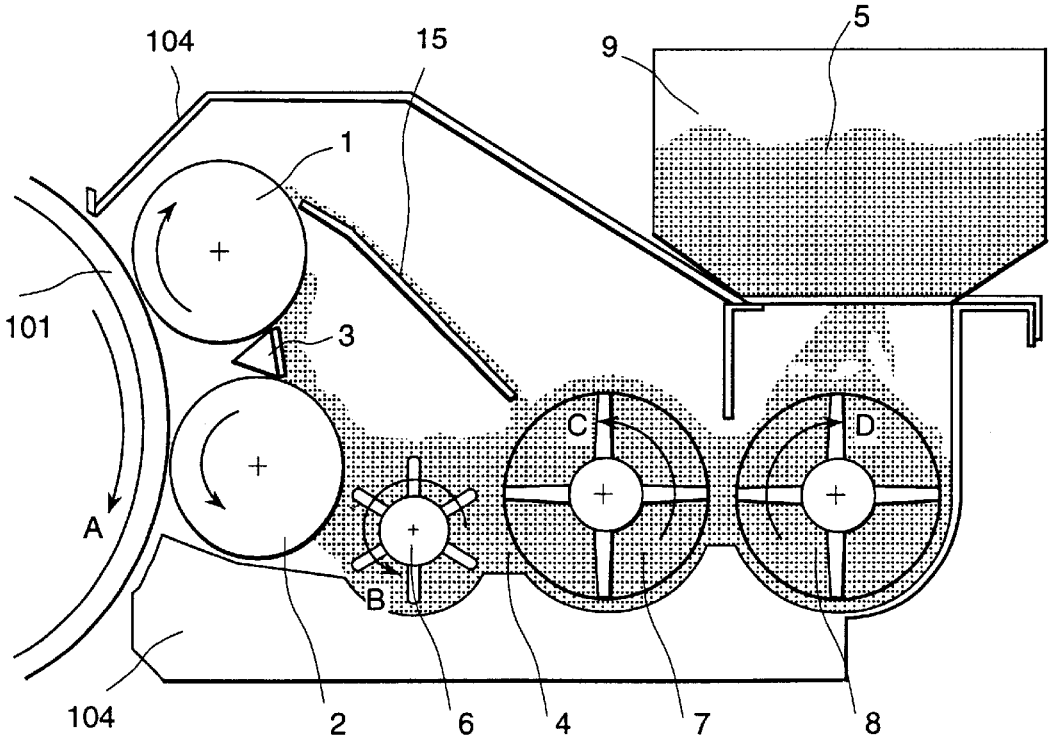
FIG. 2 diagrammatically shows the whole developing system according to the first embodiment of the present invention.

Referring to FIG. 1 and FIG. 2, a first embodiment of the present invention will be explained. FIG. 1 diagrammatically shows a magnified view of a developing system which represents a first embodiment of the present invention. FIG. 2 diagrammatically shows the whole developing system of the first embodiment.

This embodiment relates to a developing system 104 having an image carrier called a "photoconductive drum" 101 and two developing rollers 1 and 2 which are provided opposite to the photoconductive drum 101. The developing roller 2 is placed on the downstream side in a direction of rotation A of the photoconductive drum and rotates counterclockwise (along the direction of rotation A of the photoconductive drum 101) as seen in FIG. 2. The developing roller 1 is placed on the upstream side in the direction of rotation A of the photoconductive drum and rotates clockwise (opposite to the direction of rotation A of the photoconductive drum 101) as seen in FIG. 2. Although this embodiment uses two developing rollers, this number of developing rollers is suggested for purpose of explanation only and is not intended as a definition of the limits of the present invention. For example, the developing system can have a plurality of developing rollers above the developing roller 1 (on the upstream side in the direction of rotation of the photoconductive drum 101) or a plurality of developing rollers below the developing roller 1 (on the downstream side in the direction of rotation of the photoconductive drum 101). Further, the image carrier, which is represented as a photoconductive drum in the present embodiment, can be, for example, a photoconductive belt which circulates on a special track.

The developing system 104 has a parting plate called a "doctor blade" 3 between the developing rollers 1 and 2. Referring to FIG. 1, in order to always place a preset amount of developing agent 4*a* or 4*b* on the surface of each developing roller 1 or 2, the doctor blade 3 is located so as to produce gap widths G1 and G2 at the limiting positions J1 and J2 (between an end of the base side of the doctor blade 3 and the surface of a respective developing roller). Hereinafter, this gap is termed the "doctor gap" and the sizes of the gaps are expressed by symbols G1 and G2. This embodiment employs a single-block metallic doctor blade 3 to regulate the amount of developing agents 4*a* and 4*b* using a single blade.

In the embodiment shown in FIG. 1 and FIG. 2, the agent for rendering latent images visible is called a "developing agent" 4 and consists of a magnetic powder called a "carrier" and a toner powder for rendering latent images visible on the surface of the photoconductive drum 101. The weight ratio (in percentage) of toner powder to the whole developing agent is 2% to 4%. Since the printer (not illustrated here) using this developing system consumes only the toner in the developing agent 4 while printing is in progress, the weight ratio of the toner to the whole developing agent is gradually reduced in the developing system 104. To homogenize the developing agent, the developing system 104 of this embodiment, as seen in FIG. 2, contains means 7 and 8 for mixing and stirring the developing agent 4 and toner 5 supplied from the toner cartridge 9 into the developing system 104. The mixing and stirring means 7 and 8 are provided in the form of spiral gears. The means 7, which rotates in the direction of arrow C, transfers the developing agent from the front side of the developing system 104 to the rear side of the developing system 104. In contrast, the means 8, which rotates in the direction of arrow D, transfers the developing agent from the rear side of the developing system 104 to the front side of the developing system 104. This mixing homogenizes the developing agent 4 from the rear side of the developing system to the front side (to have an identical weight ratio). During this mixing and stirring by the means 7 and 8, the toner and the carrier rub against each other in the developing system 104 to generate frictional charges, and respectively attain preset charges. The charge on the toner in this embodiment is −10 $\mu$c/g to −30 $\mu$c/g.

After being adjusted to have a preset weight ratio and a preset quantity of charge, the developing agent 4 is moved leftward (in FIG. 2) over the transport means 6 toward the developing roller 2 by the rotation of the transport means 6 in the direction B.

Referring to FIG. 1, the developing rollers 1 and 2 respectively contain a stationary magnet means 20*a*, having magnet pieces polarized in the order of N3, S4, N4, S5 and N5, and a stationary magnet means 20*b*, having magnet pieces polarized in the order of S1, N1, S2, N2, and S3. Further, the developing rollers 1 and 2 respectively have rotatable sleeves 21*a* and 21*b* on their outer peripheries. The developing agent 4 near the developing roller 2 is attracted to the surface of the sleeve 21*b* by the magnet pole S1 of said magnet 20*b* and is moved towards the doctor blade 3 via the magnet poles S1 and N1 as the sleeve 21*b* rotates.

The thickness of the layer of developing agent 4*b* on the sleeve 21*b* is regulated by the doctor gap G2 at the position J2 of the doctor blade 3, and the developing agent 4*b* is moved to the developing area of the developing roller 2 which is disposed at the N2 position via the magnet pole S2. Part or all of the excessive developing agent which is stopped by the doctor blade 3 is attracted to the surface of the sleeve 21*a* by the magnetic forces of magnetic poles N3 and S4 of the magnet means 20*a*. As the sleeve 21*a* rotates, the developing agent on the sleeve 21*a* is carried through the doctor gap G1 at the regulating position J1 of the doctor blade 3, is regulated to a preset quantity, and then is moved to the developing area of the developing roller 1 which is disposed at the N4 position via the magnet pole S4.

Before the photoconductive drum 101 reaches the developing areas of the developing rollers 1 and 2, image areas and non-image areas are formed on the surface of the photoconductive drum by conventional charging and exposing processes (not illustrated here) and have predetermined potentials. A power supply (not illustrated here) supplies a developing bias to the developing rollers 1 and 2 to cause only toner in the developing agent to move to the image areas on the photoconductive drum 101. The image area on the photoconductive drum 101 is rendered visible with the application of toner thereto. This toner image is transferred to paper by a transferring process (not illustrated here) and fixed by a fixing process (not illustrated here).

To obtain a preset developing performance from the developing system 104 in the aforesaid serial image printing operation, it is very significant to guide the excessive developing agent on the developing roller 2 steadily to the developing roller 1. This method will be explained in detail with reference to FIG. 3, which illustrates the disposition of the magnetic poles in the developing rollers, and FIG. 4, which illustrates the relationship between the position of the magnetic poles on each developing roller and the quantity of developing agent which is regulated by the doctor blade 3.

Figure 3:
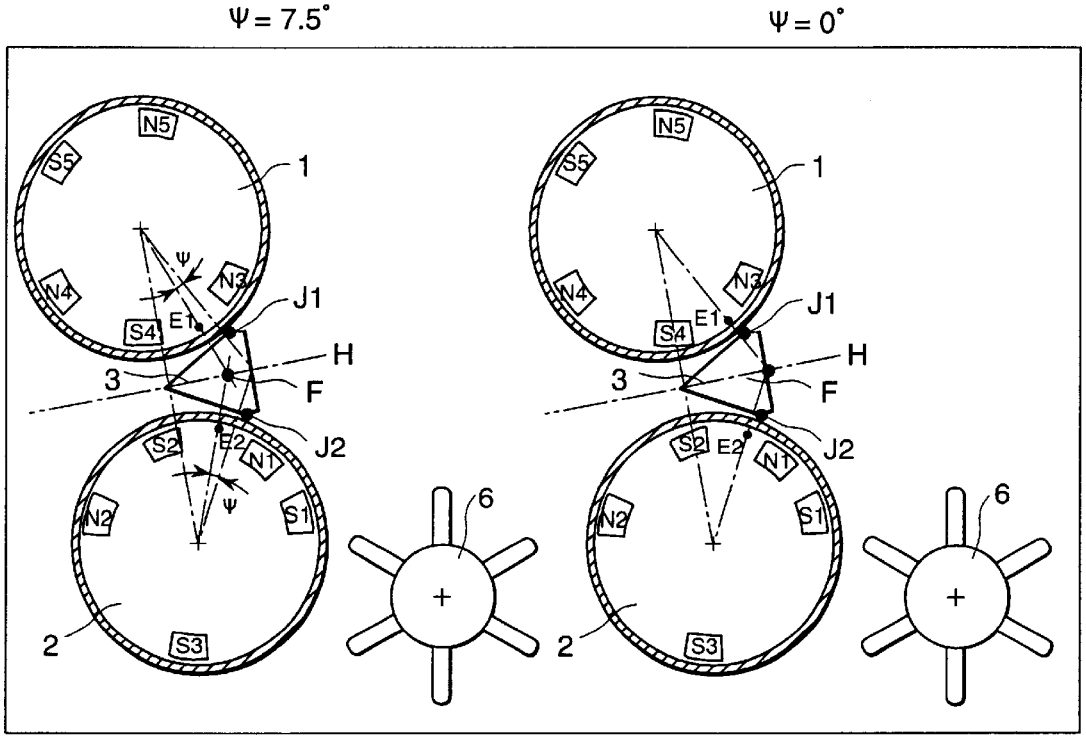
FIG. 3 is a diagram which shows the disposition of magnetic poles in the developing rollers.

Referring to FIG. 3, the pole N1 in the rotational upstream area of the developing roller 2, the pole S2 in the rotational downstream area of the developing roller 2, and a point E2 at which the polarities of N1 and S2 change (called the "Polarity reversing position") are respectively bisymmetrical relative to the pole N3 in the rotational upstream area of the developing roller 2, the pole S4 in the rotational downstream area of the developing roller 1, and a point E1 at which the polarities of N3 and S4 change around a straight line H which is a perpendicular bisector of a line segment connecting the central axes of the developing rollers 1 and 2 (called "bisymmetric line"). This arrangement need not always be completely symmetrical. The magnetic poles can be slightly shifted along the direction of rotation of each developing roller. If the developing rollers 1 and 2 have polarities S and S at the pole positions on the left side of the doctor blade 3 (on the rotational downstream side of the developing rollers), that is, S4 and S2 and their vicinity in the present embodiment, the developing agent will not be transferred at these pole positions. This is not preferable. To solve this problem, the positional arrangement of magnetic poles in the developing rollers 1 and 2 relative to the doctor blade 3 should be approximately bisymmetrical around the bisymmetric line H. In this magnetic pole configuration, the magnetic poles N3 and N1 to the right of the doctor blade 3 (on the upstream side) have an identical polarity and, consequently, the developing agent will not be transferred between these pole portions on the developing rollers 1 and 2. To make this transfer stable, the present invention uses the polarity reversing positions E1 and E2 effectively.

This method will be explained in more detail below. The developing agent transferred to the vicinity of the developing roller 2 by the transfer means 6 is attracted to the sleeve 21*b* by the magnetic pole S1, and is then carried by the rotating sleeve to the position of the magnetic pole N1. As the developing roller 2 continues to rotate, the developing agent is carried from the magnetic pole N1 to the magnetic pole S2. Halfway to the S2 position, the magnetic forces of the N1 and S2 poles neutralize each other on a line segment running from the central axis of the developing roller 2 to the polarity reversing position E2.

As the polarity reversing position E1 on the developing roller 1 is bisymmetric to the polarity reversing position E2 on the developing roller 2 about said bisymmetric line H1 a line segment running from the central axis of the developing roller 2 to the polarity reversing position E2 and a line segment running from the central axis of the developing roller 1 to the polarity reversing position E1 meet on said bisymmetric line H. Hereinafter, this intersection will be called a polarity reversing intersection F.

Figure 11:
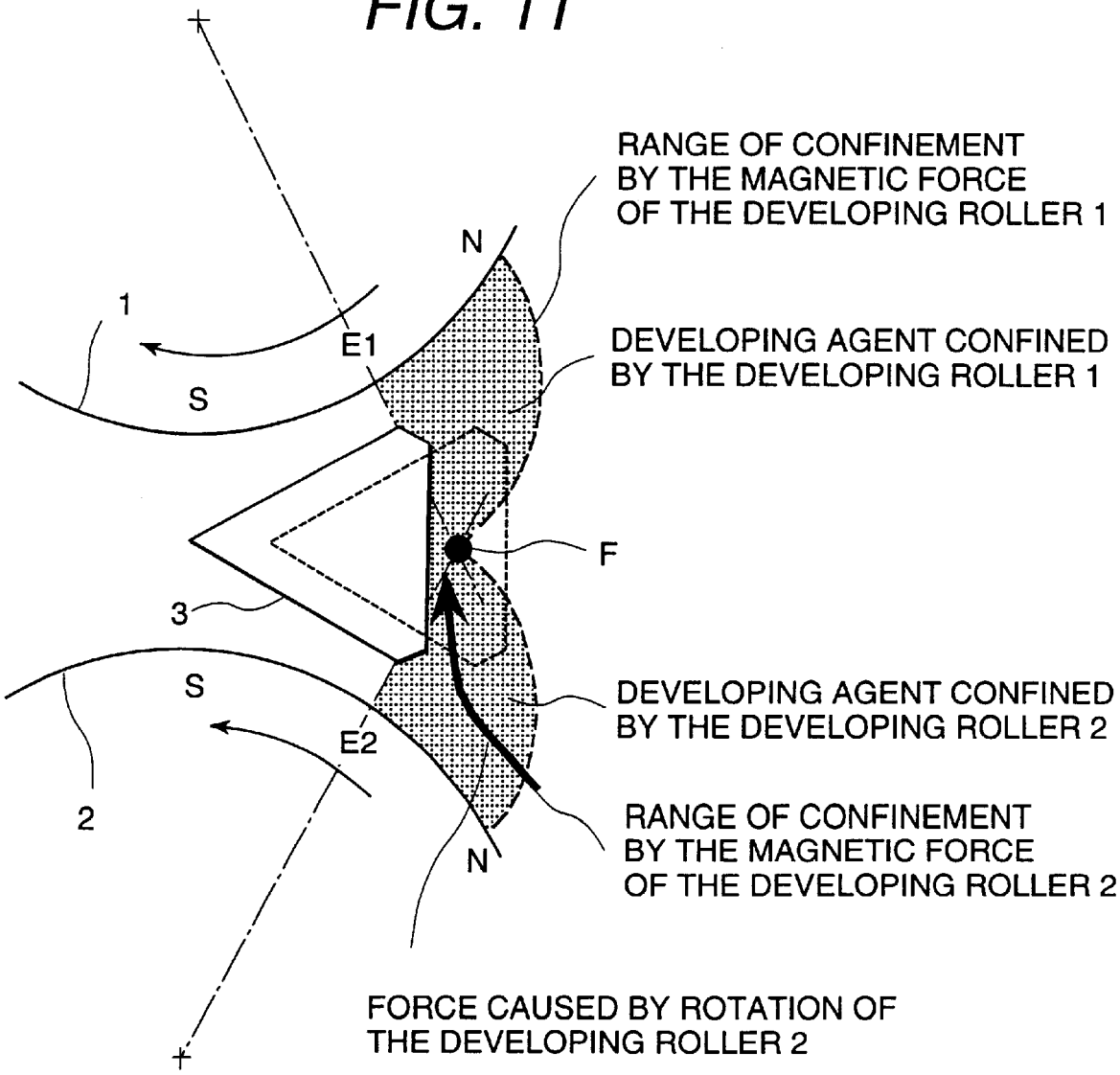
FIG. 11 is a diagrammatic view which shows the behavior of the developing agent in the vicinity of the doctor blade.

FIG. 11 illustrates the behavior of the developing agent in the vicinity of the doctor blade 3. On the upstream side from the polarity reversing intersection F, the developing agent attracted by the magnetic force of the developing roller 1 is not in contact with the developing agent attracted by the magnetic force of the developing roller 2 because of the repulsive magnetic forces of the developing rollers 1 and 2, as shown in FIG. 11. However, the magnetic repulsion is the weakest at the polarity reversing intersection F, so that the developing agent attracted by the developing roller 1 is in contact with the developing agent attracted by the developing roller 2 at this point. Further, the developing agent conveyed by the developing roller 2 is easily transferred out of the area of magnetic attraction by the developing roller 2 and enters the area of magnetic attraction by the developing roller 1 as the developing agent is pushed up by the rotation of the developing roller 2. Therefore, when the polarity reversing intersection F is to the right (on the upstream side) of the doctor blade 3, the developing agent can be easily transferred from the developing roller 2 to the developing roller 1. On the contrary, when the polarity reversing intersection F is to the left (on the downstream side) of the doctor blade 3, the developing agent attracted to the developing roller 2 cannot be continuous with the developing agent attracted to the developing roller 1. Consequently, under this condition, the developing roller 1 will receive insufficient developing agent.

Figure 4:
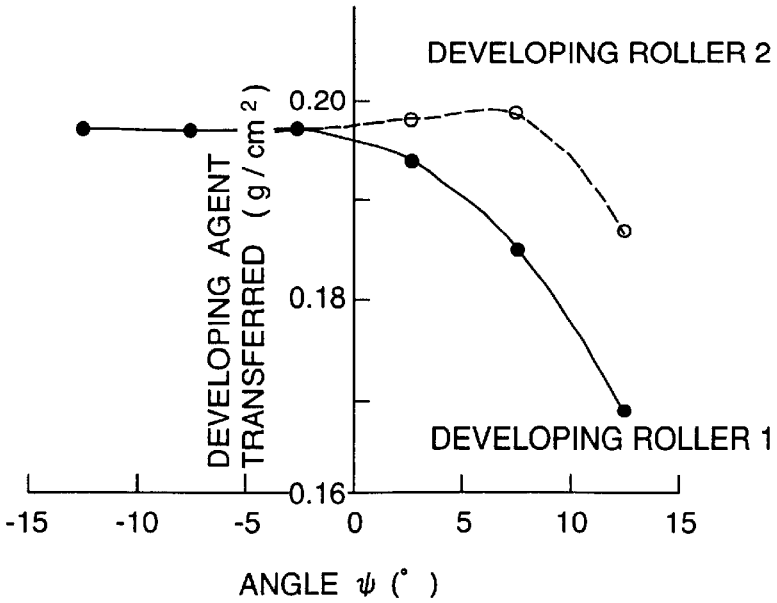
FIG. 4 is a graph showing a relationship between the position of the magnetic poles on each developing roller and the quantity of developing agent which is regulated and conveyed to the developing rollers.

FIG. 4 shows the relationship between quantities of developing agent (measured) which pass through each doctor gap (between the doctor blade and the developing roller 1 or 2) and the angles (phi) of the polarity reversing position E (E1 or E2) rotated around the central axis of each developing roller (1 or 2). The angle (phi) is positive when the polarity reversing position E1 (or E2) of the developing roller 1 (or 2) is moved along the direction of rotation of the developing roller 1 (or 2) starting at a position where the line connecting the polarity reversing position E1 (or E2) and the central axis of the developing roller 1 (or 2) runs to the polarity reversing intersection F. The measurement has been made assuming that the doctor gap G1 (or G2) between the doctor blade and the developing roller 1 (or 2) is 0.006 cm. As seen from FIG. 4, when the angle (phi) is 7.5 degrees, that is, when the polarity reversing intersection F is to the left (on the downstream side) of the doctor blade 3, the developing roller 2 has sufficient developing agent to transfer but the developing roller 1 does not. When the angle (phi) is 0 or negative degrees, that is, when the polarity reversing intersection F is to the right (on the upstream side) of the doctor blade 3, both the developing rollers 1 and 2 have sufficient developing agent. Judging from this result, the present invention places said polarity reversing intersection F to the right (on the upstream side) of the doctor blade 3 to steadily supply the developing agent from the developing roller 2 to the developing roller 1.

In addition to this, the quantity of developing agent passing by the doctor blade 3 is also determined by the regulating positions J1 and J2 of the doctor blade 3. In this embodiment, the quantity of developing agent passing through a gap between the developing roller 2 and the doctor blade 3 is determined only by said regulating position J2 independently of the position of said polarity reversing intersection F. Namely, when the angle (phi) becomes greater than about 10 in FIG. 4, the developing roller 2 has less developing agent to carry, similarly, when the angle (phi) is smaller than 12.5 degrees (not illustrated here), the quantity of developing agent to be carried is reduced. As for the doctor blade 3 of this embodiment, when the angle (phi) is −2.5 degrees, the said regulating points J1 and J2 are respectively on the lines which connect the polarity reversing position E1 (E2) of the developing roller 1 (2) and the central axis of the developing roller 1 (2). The optimum quantity of developing agent can be carried when the angle (phi) is the above angle (−2.5 degrees) ±10 degrees. In FIG. 3, the magnetic poles of the developing rollers 1 and 2 are disposed so that the angles of sectors N1–S2, N3–S4, E2–S2 and E1–S4 may be respectively 60 degrees, 60 degrees, 30 degrees, and 30 degrees (in that order). Accordingly, this value is one third of the angle of a sector E1–S4 (E2–S2) or E1–N3 (E2–N1). In this case, when the regulating points J1 and J2 are placed to the left (on the downstream side) of the polarity reversing positions E1 and E2, the area for said polarity reversing intersection F becomes wider on the upstream side of the doctor blade 3. To reduce the stresses on the developing agent during regulation by the doctor blade 3, however, this embodiment places the regulating points J1 and J2 on the polarity reversing positions E1 and E2 which have the weakest magnetic attraction on the developing roller.

The shape of the doctor blade 3 is also significant to place said polarity reversing intersection F to the right (on the upstream side) of the doctor blade 3 in this setting. This will be explained with reference to FIG. 5 which shows the conceptual configuration of the doctor blade 3.

Figure 5:
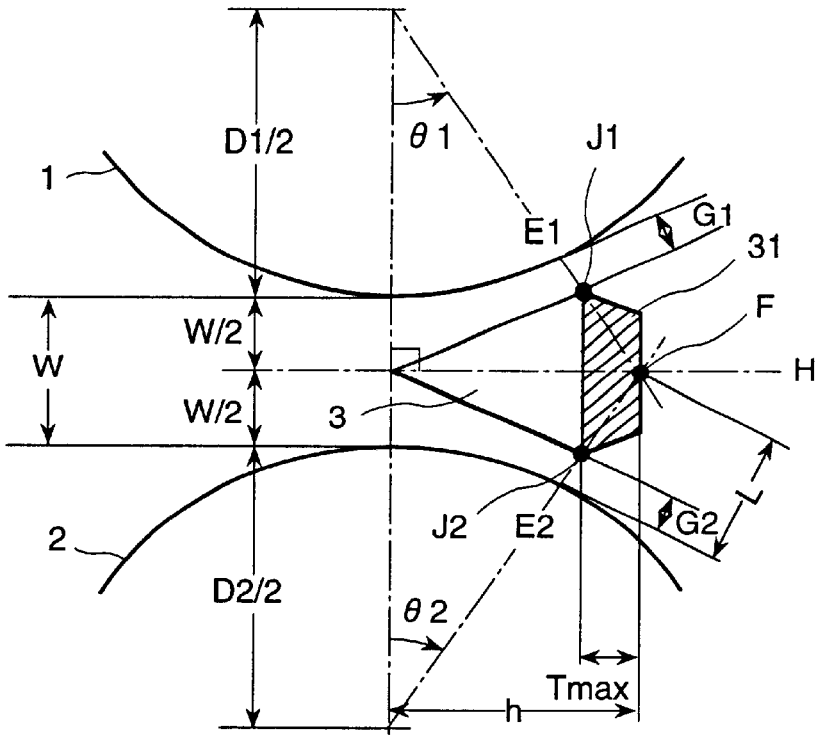
FIG. 5 is a diagram showing the configuration of the doctor blade.

Referring to FIG. 5, the doctor blade 3 has a trapezoidal side plate 31 (hatched in the figure) on the base side (upstream side) of the doctor blade 3 (to the right of the regulating points J1 and J2) to form doctor gaps G1 and G2 at the regulating points J1 and J2. This side plate 31 is provided to reinforce the base edges of the doctor blade 3.

Without this side plate, the base edges may be quickly damaged. However, if this side plate 31 is thick, it will be hard to place said polarity reversing intersection F to the right (on the upstream side) of the doctor blade 3.

Now let's assume the following:

D1, D2: Diameters (in centimeters) of the developing rollers 1 and 2 (D1=D2)

W: Distance (in centimeters) between the circumferences of the developing rollers 1 and 2

G1, G2: Doctor gaps (in centimeters) (G1=G2)

θ1, θ2: Angle (in degrees) made by a line segment connecting the central axes of the developing rollers 1 and 2 and a line segment connecting the central axis of the developing roller 1 (or 2) and a polarity reversing position E1 (or E2)

The distance h between the rightmost end of the doctor blade 3 and a line segment connecting the central axes of the developing rollers 1 and 2 must be smaller than the following judging from the geometrical arrangement of the components:

$$h=\{(D1+D2)/2+W\}\sin\theta1\sin\theta2/\sin(\theta1+\theta2) \quad (1)$$

In this status, the maximum thickness Tmax of said side plate is $$Tmax=h-(D2/2+/G2)\sin\theta2 \quad (2)$$

The distance L between said polarity reversing intersection F and each developing roller is $$L=h/\sin\theta2-D2/2 \quad (3)$$

wherein θ1 and θ2 are 0 to 90 degrees (not including 90 degrees). If the angles θ1 and θ2 are smaller than 0, the polarity reversing intersection F may be to the left (on the rotational downstream side of the developing rollers) of the regulating points J1 and J2. If the angles θ1 and θ2 are smaller than 0 when the regulating points J1 and J2 are not on the polarity reversing points E1 and E2, the area for polarity reversing intersection F may be narrower to the right (on the upstream side) of the doctor blade 3. Further, in this case, the space for the excess developing agent stopped by the doctor blade 3 becomes smaller and the developing agent may be compressed tightly, which increases the stress on the developing agent and shortens the service life of the developing agent.

Although this embodiment uses a trapezoidal side plate 31 to guide the developing agent to said doctor gaps G1 and G2 effectively, it can be an arched side plate as well. The maximum thickness Tmax of the arched side plate is the length between the bottom and the top of the arch.

Figure 6:
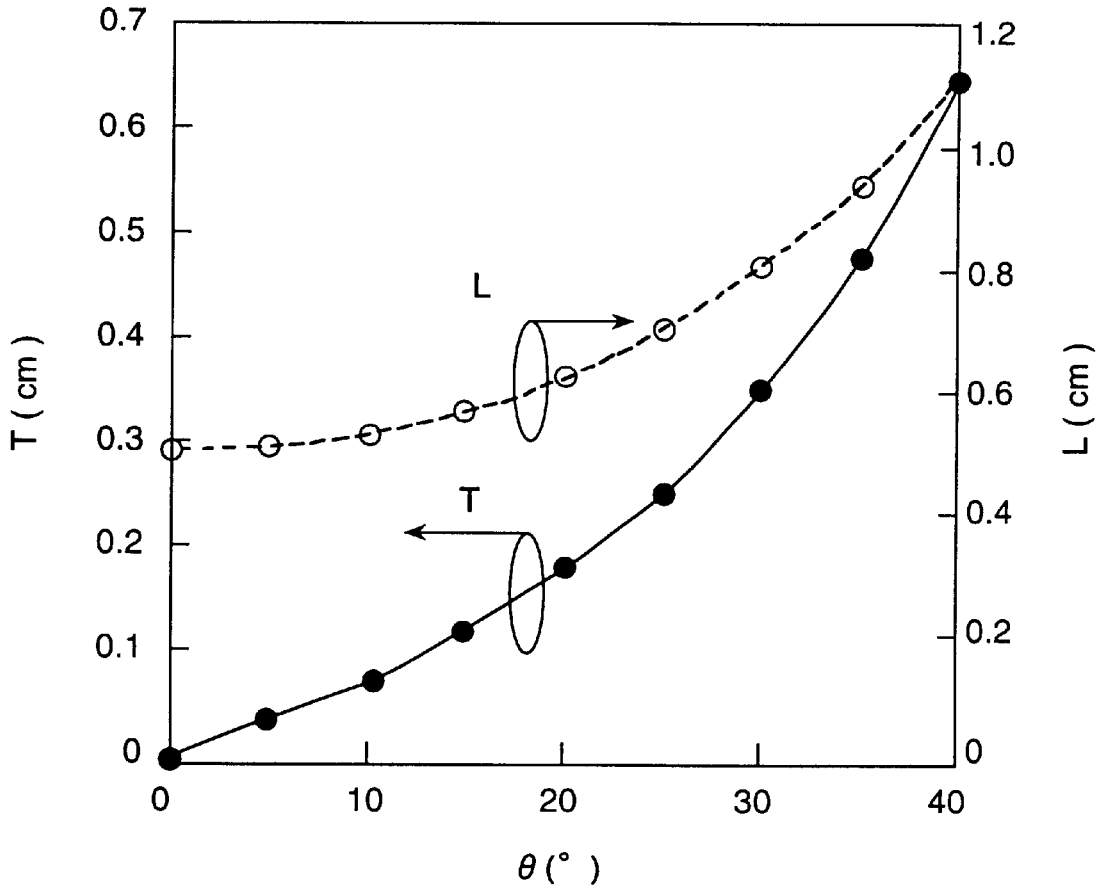
FIG. 6 is a graph which shows a relationship of magnetic pole positions, the disposition of the doctor blade, and the quantities of developing agents required.

FIG. 6 shows a relationship (a result of calculation) between the thickness Tmax of the side plate and the angles θ1 (or θ2) in the expression (1) assuming D=3 (cm), W=1 (cm), and G=0.1 (cm). In this relationship, the Tmax value can be greater as the angle 0 becomes greater. However, as the angle 0 becomes greater, the distance L between the developing roller 2 and said polarity reversing intersection F (illustrated in FIG. 6) also becomes greater. This L value is considered to be a minimum height required to transfer the developing agent from the developing roller 2 to the developing roller 1 at the polarity reversing position E2 of the developing roller 2. In other words, when the angle θ is great, the quantity of developing agent conveyed to the developing roller 2 will also be great.

Figure 7:
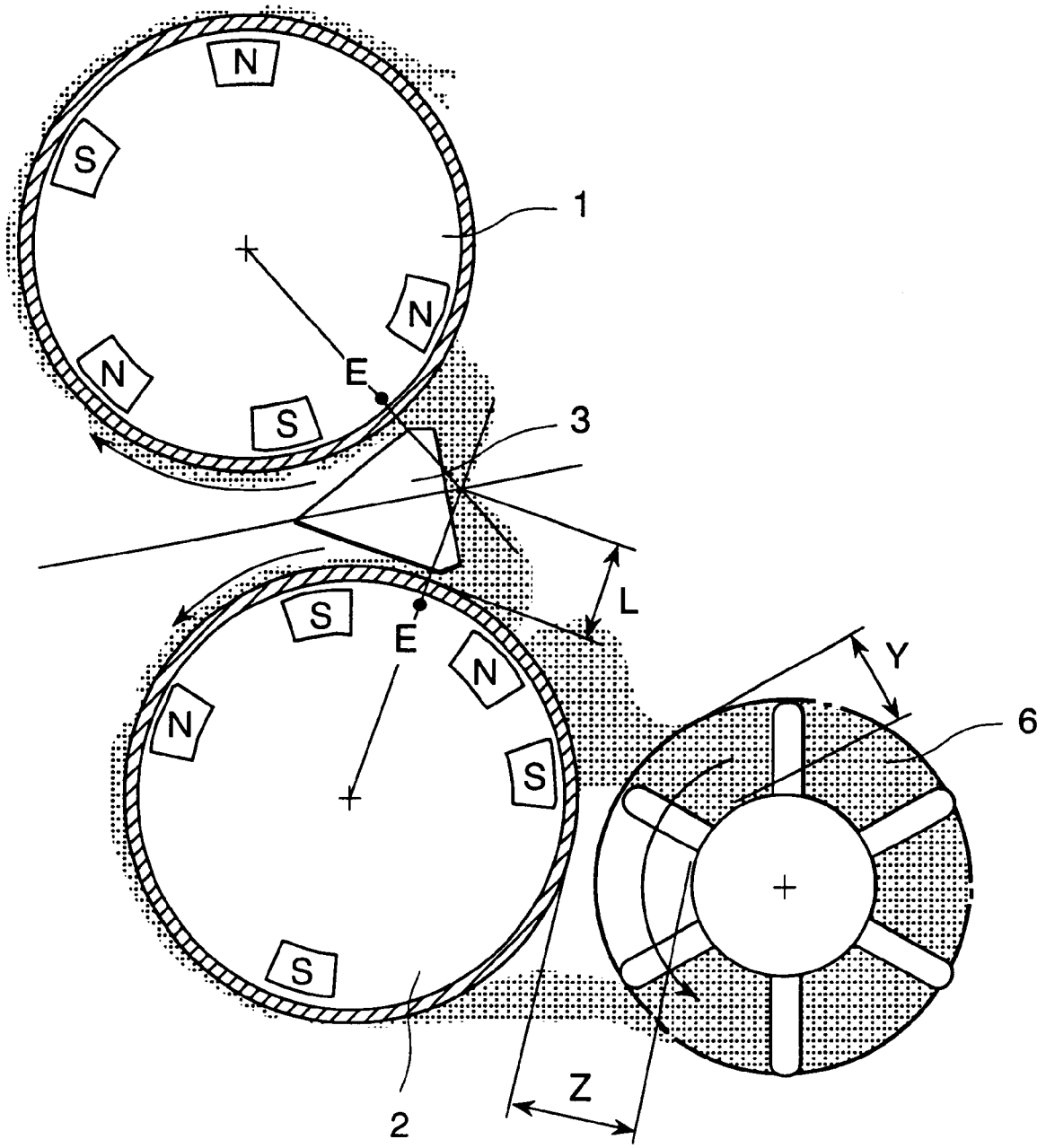
FIG. 7 is a diagrammatic view showing the transfer path of the developing agent and the arrangement of developing rollers and the transfer means.

This quantity of developing agent is determined by the relationship between the developing roller 2 and the transfer means 6. The height of the layer of developing agent at the polarity reversing position E2 is proportional to the quantity of developing agent. This is because the developing agent is not attracted by a magnetic force at the polarity reversing position E2, since the developing agent is just carried on the developing roller 2, that is, the height of the developing agent layer is determined by the packing density of the developing agent. As shown in FIG. 7, which diagrammatically illustrates the transfer path of the developing agent and the arrangement of developing rollers and the transfer means, this embodiment employs an impeller having vanes as the transfer means 6. In this configuration, the developing agent is just carried on the vanes of the impeller like the developing agent at the polarity reversing position E2, and the packing density of the developing agent on the impeller is equal to that on the developing roller 2 at said polarity reversing position E2. Therefore, the sum of the vane height and the distance between the top of the vane and the surface of the developing roller 2, that is, the transfer path clearance z, must be equal to or greater than the distance L between the developing roller 2 and the polarity reversing intersection F. However, the clearance gap z must be much greater than the distance L as the excess part of the developing agent conveyed to the vicinity of the doctor blade 3 by the developing roller 2 is supplied to the developing roller 1. As a result of measurement in this embodiment, it has been found that the clearance z must be more than 1.5 times the distance L to allow ample developing agent to pass through the doctor gaps between the doctor blade 3 and the developing rollers 1 and 2. At the magnetic pole positions S2 and S4 in FIG. 3, the ears of developing agent are 0.2 cm to 0.3 cm high along lines of magnetic force even when the doctor gaps G1 and G2 are very small (about 0.05 cm). Accordingly, the distance W between developing rollers 1 and 2 must be at least 0.5 cm. If not, the ears of the developing agent on the developing rollers 1 and 2 will be disturbed, which is undesirable. When the magnetic force on the surface of the developing roller is 1000 gausses, the recommended thickness of the developing agent layer is 1.5 cm or less. Further, to reduce the rotational load of the developing rollers due to the increase in weight provided by the developing agent, the thickness of the developing agent layer should be 1 cm or less.

Since the clearance size z (that is, the thickness of the developing agent layer) must be more than 1.5 times the distance L, the distance W between the developing rollers 1 and 2 must be under 2 cm when the layer of the developing agent is 1.5 cm high or under 1.3 cm when the layer of the developing agent is 1 cm high. When the distance W between the developing rollers 1 and 2 is under 1.3 cm, the distance L must be 0.65 cm or less to supply sufficient developing agent through the doctor gaps (between the doctor blade 3 and the developing rollers 1 and 2). In this case, the distance W between the developing rollers 1 and 2 must be 0.5 cm or more to satisfy the height of the ears of the developing agent at the magnetic pole positions S2 and S4. In the case of typical developing rollers whose diameters D1 and D2 are 2 cm to 5 cm, the angle θ2 made by a line segment connecting the central axes of the developing rollers 1 and 2 and a line segment connecting the central axis of said developing roller 2 and the polarity reversing position E2 must be less than 50 degrees when the diameters D1 and D2 are 2 cm (D1=D2), less than 45 degrees when the diameters D1 and D2 are 3 cm (D1=D2), and less than 40 degrees when the diameters D1 and D2 are 5 cm (D1=D2). In short, the angle θ2 must be at least less than 50 degrees and preferentially less than 40 degrees.

Figure 12:
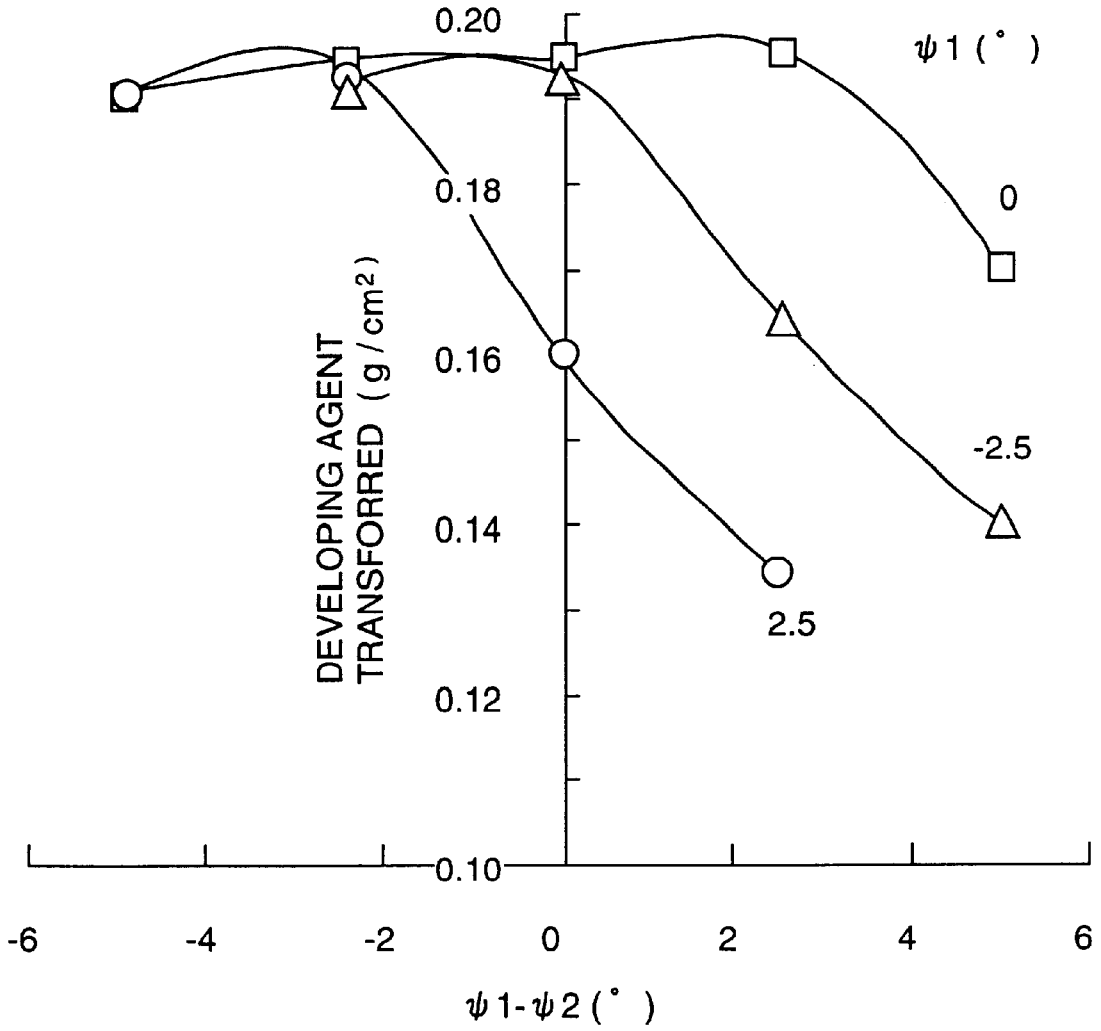
FIG. 12 is a graph which shows a relationship between the position of the magnetic poles on each developing roller and the quantity of developing agent which is regulated and conveyed to the developing rollers.

FIG. 12 shows the relationship (the result of measurement) between the quantity of developing agent passing through the doctor gap G1 of the developing roller 1 and the differences of angles ∩1 and ∩2 of the polarity reversing positions E1 and E2 of the developing rollers 1 and 2 rotated around the central axes of the developing rollers at angles of ∩1. The angles ∩1 and ∩2) are positive when the polarity reversing position E1 (or E2) of the developing roller 1 (or 2) is moved along the direction of rotation of the developing roller 1 (or 2) starting at a position where the line connecting the polarity reversing position E1 (or E2) and the central axis of the developing roller 1 (or 2) runs to the polarity reversing intersection F.

This measurement was made under the following conditions:

The distance between the rightmost end (upstream end) of the doctor blade 3 and the line segment connecting the central axes of the developing rollers 1 and 2 is 0.9 cm.

The angle made by the line segment connecting the central axes of the developing rollers 1 and 2 and a line segment connecting the regulating point J1 (J2) and the central axis of the developing roller 1 (2) is 28 degrees.

The diameter of each developing roller D1 (=D2) is 3 cm.

The distance between the developing rollers 1 and is 0.7 cm.

The doctor gaps G1 and G2 between the doctor blade 3 and the developing rollers 1 and 2 are 0.065 cm.

The thickness of the layer of the developing agent supplied to the developing roller 2 is 1 cm.

As a result, the optimum quantity of developing agent passing through the doctor gap G1 near the developing roller 1 is obtained for the angle difference ∩1−2 of under −2.5 degrees when the angle ∩1 is 2.5 degrees, the angle difference ∩1−∩2 of under 2.5 degrees when the angle ∩1 is 5 degrees or the angle difference ∩−∩2 of under 0 degree when the angle ∩1 is −2.5 degrees.

Figure 13:
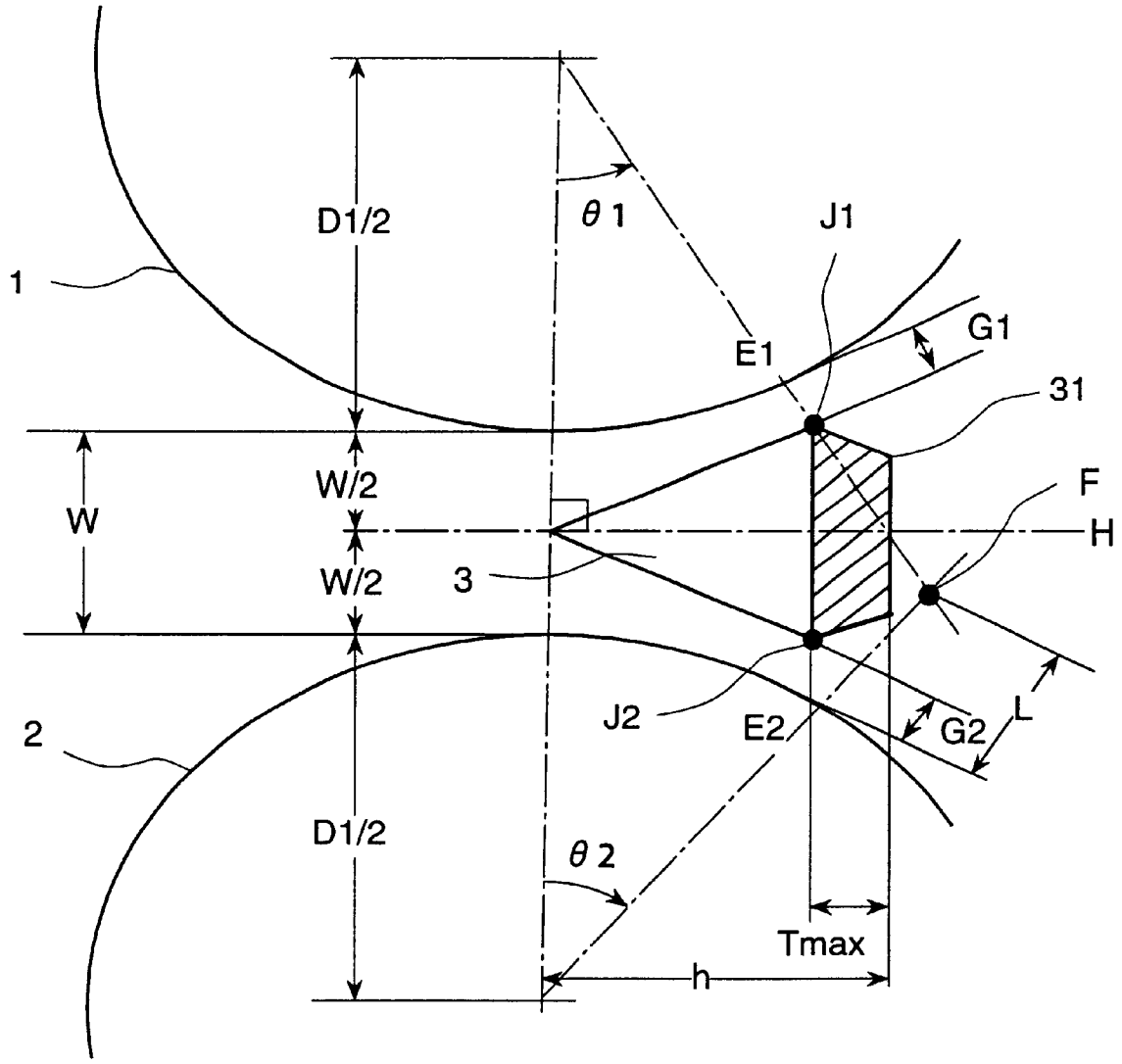
FIG. 13 is a diagrammatic view which shows the arrangement of the doctor blade.

As seen from FIG. 13 which conceptually illustrates the configuration of the doctor blade 3, this is caused by the fact that the polarity reversing intersection F is not on the bisymmetric line H, which is a perpendicular bisector of a line segment connecting the central axes of the developing rollers 1 and 2 if the angles θ1 and θ2 (angle made by a line segment connecting the polarity reversing position E1 and the central axis of the developing roller 1 and the line segment connecting the central axes of the developing rollers 1 and 2 and angle made by a line segment connecting the polarity reversing position E2 and the central axis of the developing roller 2 and the line segment connecting the central axes of the developing rollers 1 and 2) are different. Namely, this is because, when the angle 01 is smaller than the angle 02 (as illustrated in FIG. 13), the polarity reversing intersection F is below the bisymmetric line H and the distance L between the polarity reversing intersection F and the developing roller 2 becomes smaller than that when θ1 is equal to θ2. Also, in this embodiment (as illustrated in FIG. 5), the distance h between the rightmost end of the doctor blade 3 and the line segment connecting the central axes of the developing rollers 1 and 2 is expressed by formula (1) and the distance L between the polarity reversing intersection F and the developing roller 2 is expressed by formula (3), wherein D1 and D2 are the diameters of the developing rollers 1 and 2 (in centimeters); W is the distance between the developing rollers 1 and 2 (in centimeters); G1 and G2 are doctor gaps (in centimeters); and numerals 1 and 2 denote developing rollers 1 and 2. The angles θ1 and θ2 are 0 to 90 degrees (not including 90 degrees).

Figure 14:
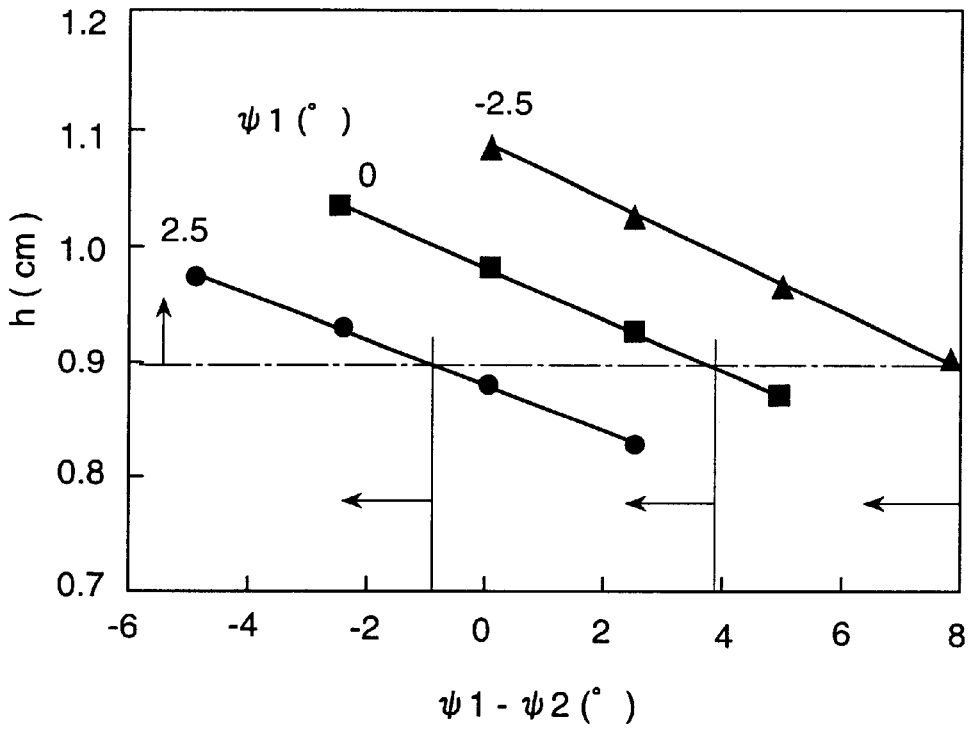
FIGS. 14(*a*) and 14(*b*) are graphs which show a relationship between the arrangement of magnetic poles in the developing rollers and the position of the polarity reversing intersection F.
Figure 14:
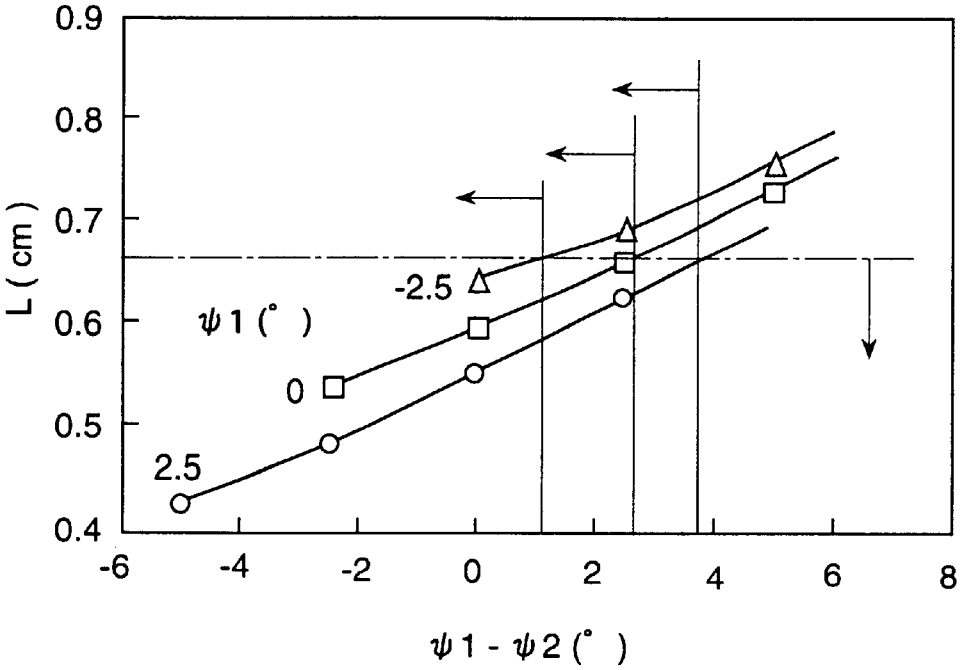

FIG. 14(*a*) shows the relationship between the difference of angles ∩1−∩2 and the distance h calculated by assigning θ1 and θ2 (obtained from θ1=23°+∩1 and 2=23°+∩2 in FIG. 12) to the formula (1). FIG. 14(*b*) shows the relationship between the difference of angles ∩1−2 and the distance L calculated by assigning θ1 and θ2 (obtained from θ1=23°+∩1 and ∩2=23°+∩2 in FIG. 12) to the formula (3). In FIG. 14(*a*), when the distance between the rightmost end (upstream end) of the doctor blade 3 and the line segment connecting the central axes of the developing rollers 1 and 2 is 0.9 cm, the polarity reversing intersection F cannot be placed to the rightmost end (upstream end) of the side plate of the doctor blade 3 unless the calculated distance h is greater than 0.9 cm. To satisfy this condition, the angle difference ∩1−∩2 must be under −1.0 degree when the angle ∩1 is 2.5 degrees, under 4 degrees when the angle ∩1 is 0 degree, or under 7 degrees when the angle ∩1 is −2.5 degrees.

Further, as seen in FIG. 14(*b*), when the distance W between the developing rollers 1 and 2 is under 1.3 cm as explained above (W=0.9 cm in this embodiment), the distance L must be 0.65 cm or less to allow ample developing agent to pass through the doctor gaps. This condition is satisfied when the angle difference ∩1−∩2 is under 3 degrees when the angle ∩1 is 2.5 degrees, under 2.5 degrees when the angle ∩1 is 0 degree, or under 1 degree when the angle ∩1 is −2.5 degrees.

To satisfy both the results of FIG. 14(*a*) and FIG. 14(*b*), the angle difference ∩1−∩2 is under −1 degree when the angle ∩1 is 2.5 degrees, under 2.5 degrees when the angle ∩1 is 0 degree, or under 1 degree when the angle ∩1 is −2.5 degrees, which is equal to the result in FIG. 12. In this way, even when the settings of angles θ1 and θ2 are different, ample developing agent can pass through the doctor gaps if the polarity reversing intersection F is positioned to the right (on the upstream side) of the rightmost end of the doctor blade 3 and if the distance L is smaller than the quantity of developing agent supplied to the developing roller 2.

Figure 8:
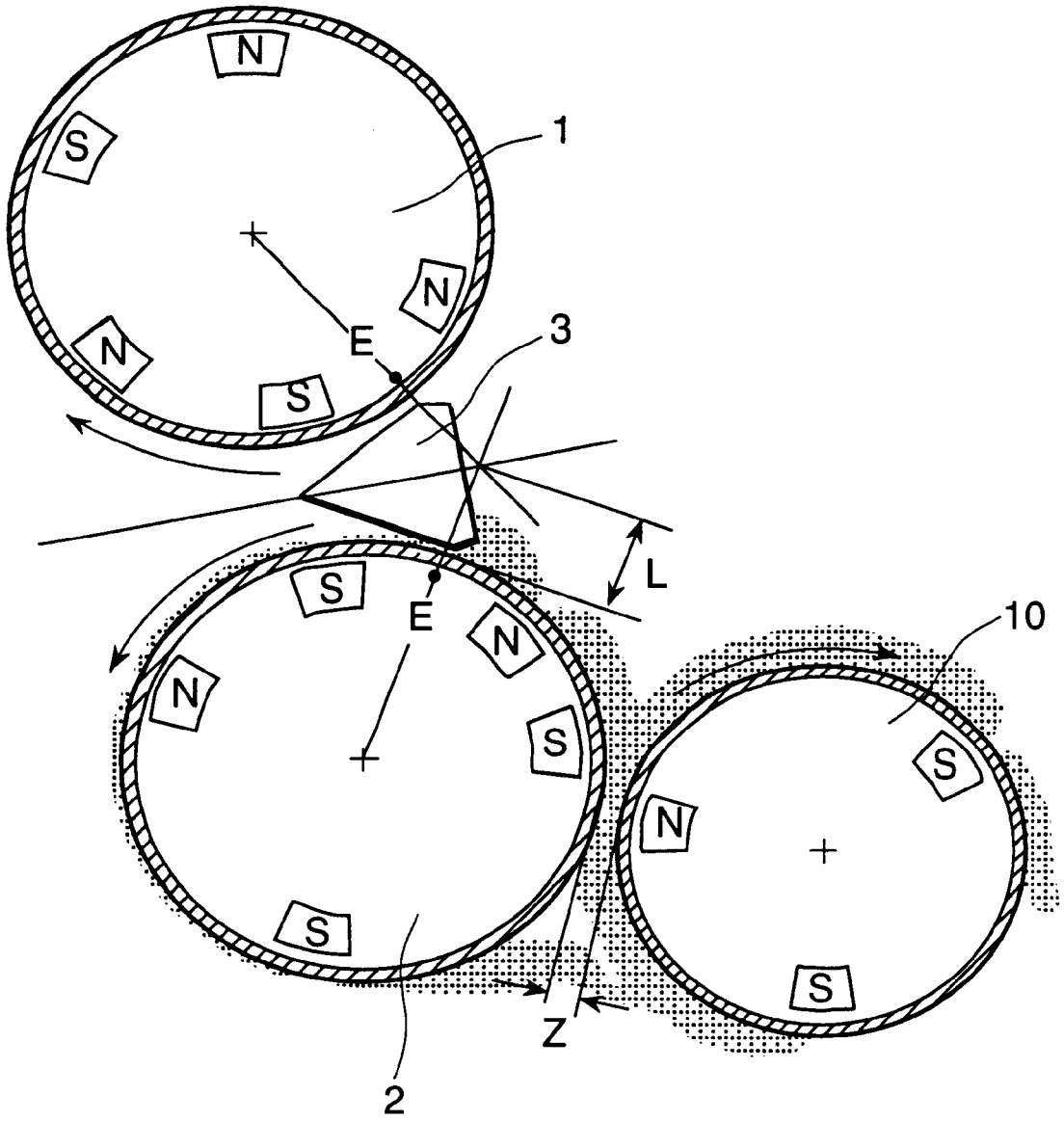
FIG. 8 is a diagrammatic view showing the transfer path of the developing agent and the arrangement of developing rollers and the transfer means of another embodiment

FIG. 8 diagrammatically illustrates the transfer path of the developing agent and the arrangement of developing rollers and the transfer means of another embodiment. This embodiment uses, as a transfer means, a magnet roller which is functionally similar to the developing rollers 1 and 2. In this configuration, if the clearance size z between the magnet roller 10 and the developing roller 2 is greater than the distance L, ample developing agent will be supplied to the developing rollers 1 and 2 through the doctor gaps. However, if the clearance size z is less than the distance L, the quantity of developing agent supplied to the developing roller 1 will be insufficient. This is because the packing density of the developing agent passing through the clearance z is equal to the density of the developing agent just placed on the developing roller. Therefore, also in this embodiment, the clearance size z must be equal to or greater than the distance L between said polarity reversing intersection F and the respective developing rollers 1 and 2, or preferentially more than 1.5 times the distance L.

Figure 9:
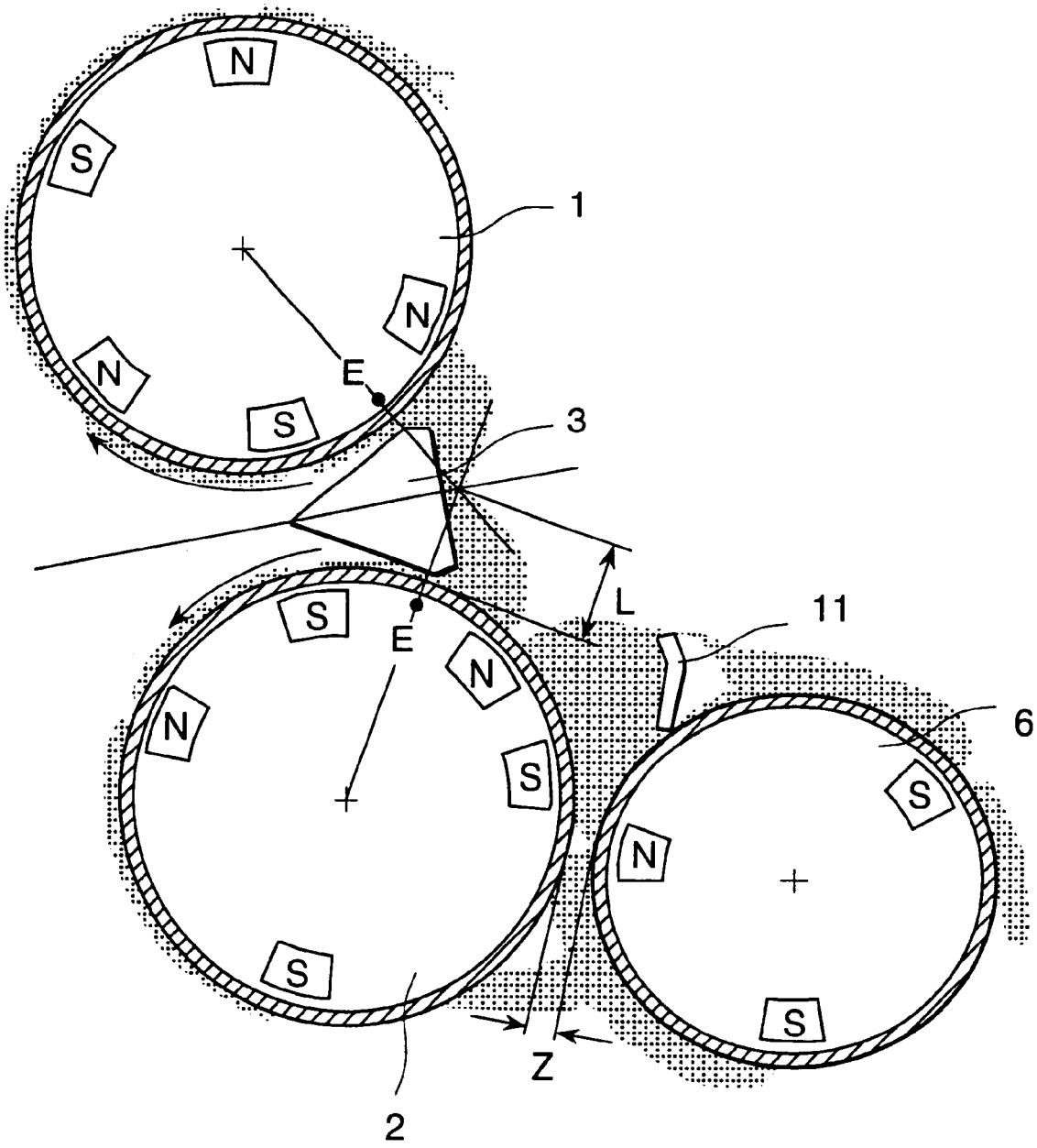
FIG. 9 is a diagrammatic view which shows the use of an auxiliary plate in a developing system which represents another embodiment of the present invention.

Further, FIG. 9 diagrammatically shows the transfer path of the developing agent and the arrangement of developing rollers and the transfer means of another embodiment whose transfer path is not dependent of the clearance size z between the developing roller 2 and the magnet roller 10. This embodiment contains an auxiliary plate 11 for blocking the developing agent carried on the magnet roller 10 from passing over the top of the magnet roller 10. This auxiliary plate works to supply ample developing agent to the developing roller 2 even when said clearance size z is small. Further, this auxiliary plate can make the developing agent higher (than distance L) on the polarity reversing position E2 of the developing roller 2. Consequently, ample developing agent can pass through the gaps between the doctor blade 3 and the respective developing rollers 1 and 2.

Figure 10:
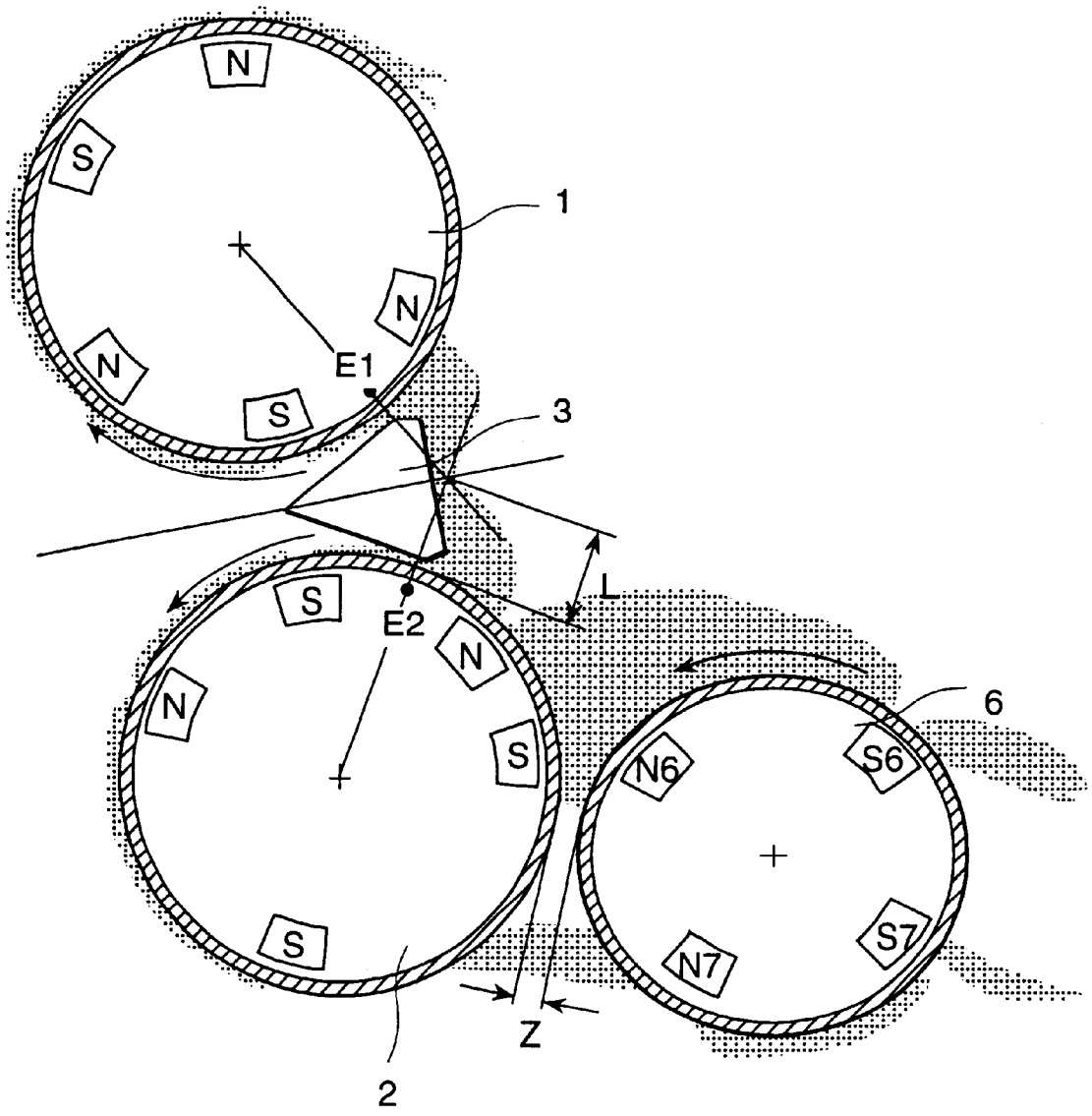
FIG. 10 is a diagrammatic view of another embodiment.

FIG. 10 diagrammatically shows the transfer path of the developing agent and the arrangement of developing rollers and the transfer means of another embodiment whose transfer path is not dependent on the distance z between the developing roller 2 and the magnet roller 10. In this embodiment, the magnet roller 10 rotates in a direction opposite to that of the magnet roller in FIG. 8 and FIG. 9. In this configuration, the developing agent is fed to the S6 position, is conveyed towards the N6 position as the magnet roller 10 rotates, and is transferred to the developing roller 2. As the distance z between the magnet roller 10 and the developing roller 2 is comparatively small, only an amount of the developing agent less than that placed on the developing roller can pass through this clearance. Accordingly, this mechanism works like the auxiliary plate 11 in FIG. 9 to hold the developing agent, and so ample developing agent is supplied to the developing roller 2 even when the developing agent supplied to the S6 position is not sufficient. Further, with this mechanism, the thickness of the layer of developing agent at the polarity reversing position E2 of the developing roller 2 can be made greater than the distance L. As a result, ample developing agent can be passed through the doctor gaps (between the doctor blade 3 and respective developing rollers 1 and 2).

Although the rightmost (upstream) side of the doctor blade 3 in these embodiments is shown as being perpendicular to the bisymmetric line H, it need not be exactly perpendicular to the bisymmetric line H. However, also in this case, the polarity reversing intersection F must be located to the right (on the upstream side) of the rightmost end of the doctor blade 3 and the distance L must be smaller than the quantity of the developing agent supplied to the developing roller 2.

Printing is carried out in said configuration under the following conditions:

Using a negatively-charged OPC as the photoconductive drum 101.

Applying −50V to the image area on the surface of the photoconductive drum 101, −600V to the non-image area, and a bias potential of 300V to the developing rollers 1 and 2.

Rotating the photoconductive drum 101 at a circumferential speed of 30 cm/second and the developing rollers 1 and 2 at the ratio of the circumferential speed (to the photoconductive drum 101) of 1:9.

Setting a clearance (distance) of 0.1 cm between the photoconductive drum 101 and respective developing rollers 1 and 2, a true density of carrier of 5 grams/$cm^3$, and a weight ratio (in percentage) of toner in the developing agent as 2.5%.

Figure 15:
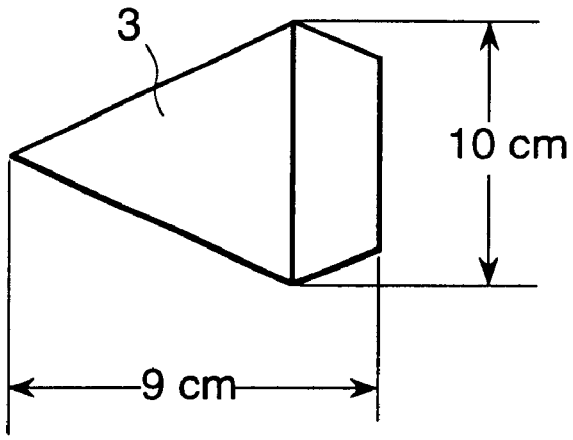
FIGS. 15(*a*) and 15(*b*) are sectional views of conventional and improved doctor blades, respectively.
Figure 15:
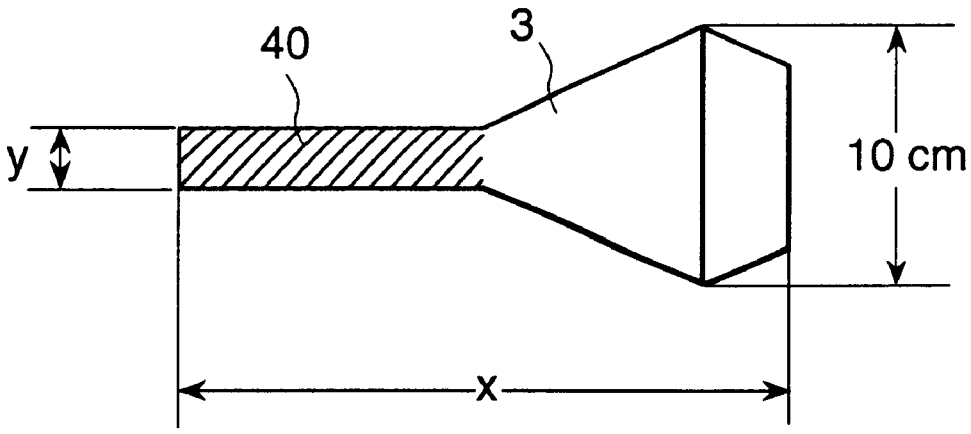

Using a doctor blade 3 made of aluminum whose Young's modulus is $7\times10^{10}$ ($N/m^2$) and whose dimensions are those given in FIG. 15(*a*) (30 cm deep).

Unless otherwise specified, all embodiments explained below assume the following:

Diameters D1 and D2 of the developing rollers 1 and 2: 3 cm.

Distance W between developing rollers 1 and 2: 7 cm.

Doctor gaps G1 and G2: 0.1 cm.

Angles θ1 and θ2 made by a line segment connecting respective polarity reversing positions E1 and E2 to the central axes of respective developing rollers and a line segment connecting the central axes of respective developing rollers: 38 degrees.

As a result of printing under the above conditions, the toner density of a printed image in the longitudinal center of the doctor blade 3 is lower than that of a printed image at each longitudinal end of the doctor blade 3. This is because the doctor blade 3 is flexed leftward (to the rotational downstream side of the developing rollers 1 and 2) at the center of the doctor blade 3 by the regulating force and, consequently, the doctor gaps G1 and G2 are made narrower. In an actual measurement, it was found that the distribution load onto the doctor blade 3 was 98N (calculated from the load on the motor for the developing rollers 1 and 2) and the flexure of the doctor blade 3 at the center was about 0.1 cm.

Figure 16:
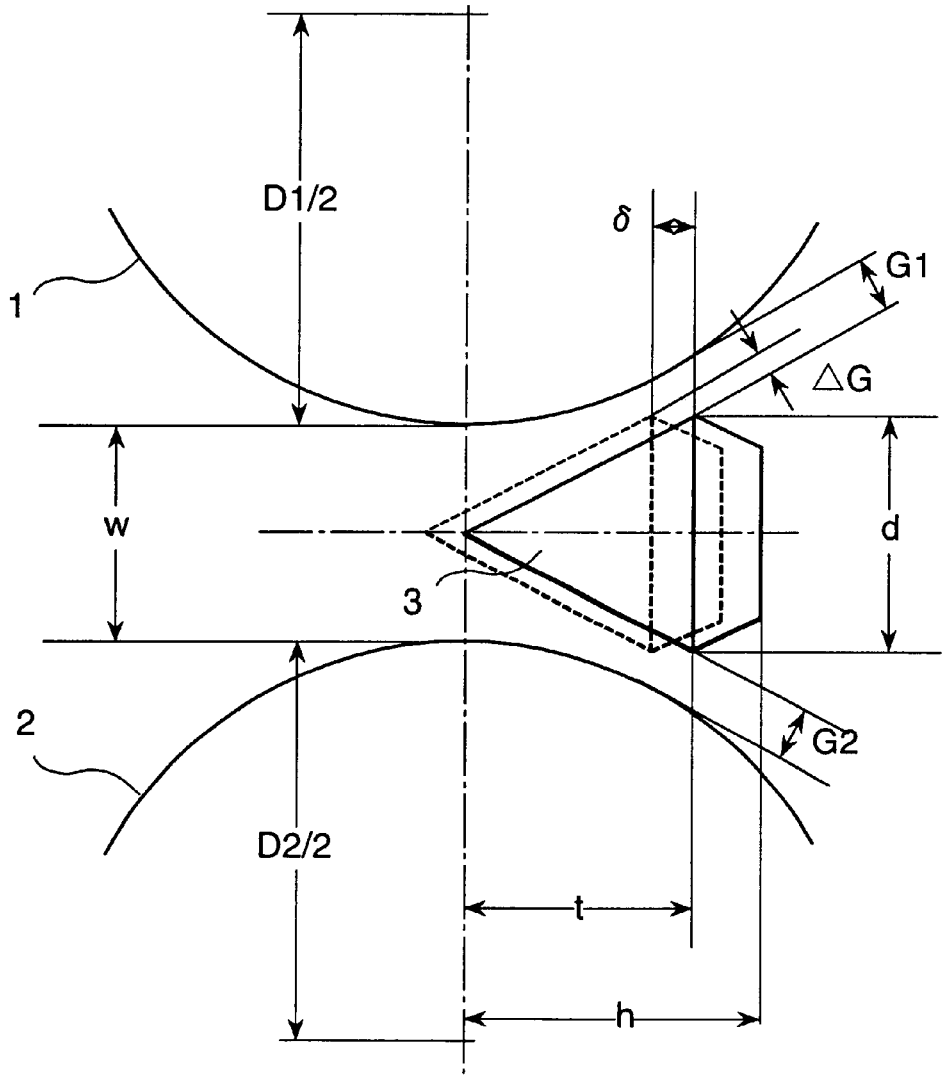
FIG. 16 is a diagram which shows how the doctor blade flexes.

FIG. 16 diagrammatically explains how much (ΔG) the doctor gap G1 moves when the doctor blade 3 flexes by δ at the longitudinal center of the blade. The quantity of movement ΔG is expressed by formula (5). The quantity of movement ΔG of the doctor blade 3 in FIG. 15(*a*) was found to be 0.04 cm. When the doctor blade 3 (in FIG. 15(*a*)) made of stainless steel whose Young's modulus is $1.9\times10^{11}$ ($N/m^2$) is used, the flexure "δ" is 0.03 cm and the movement ΔG of the doctor gap G1 is 0.02 cm, which are comparatively great.

Figure 17:
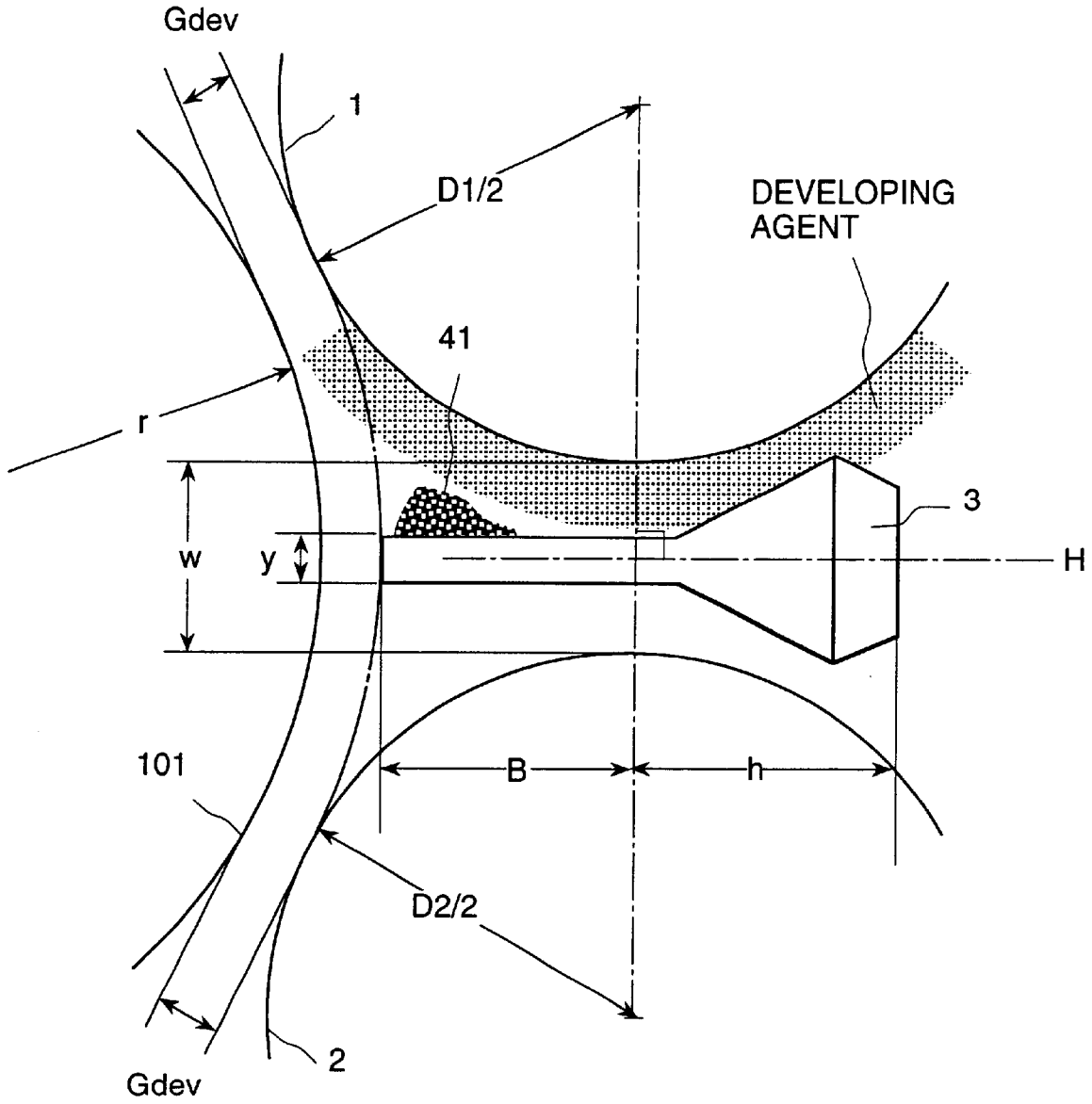
FIG. 17 is a diagram which shows the disposition of the doctor blade.
Figure 18:
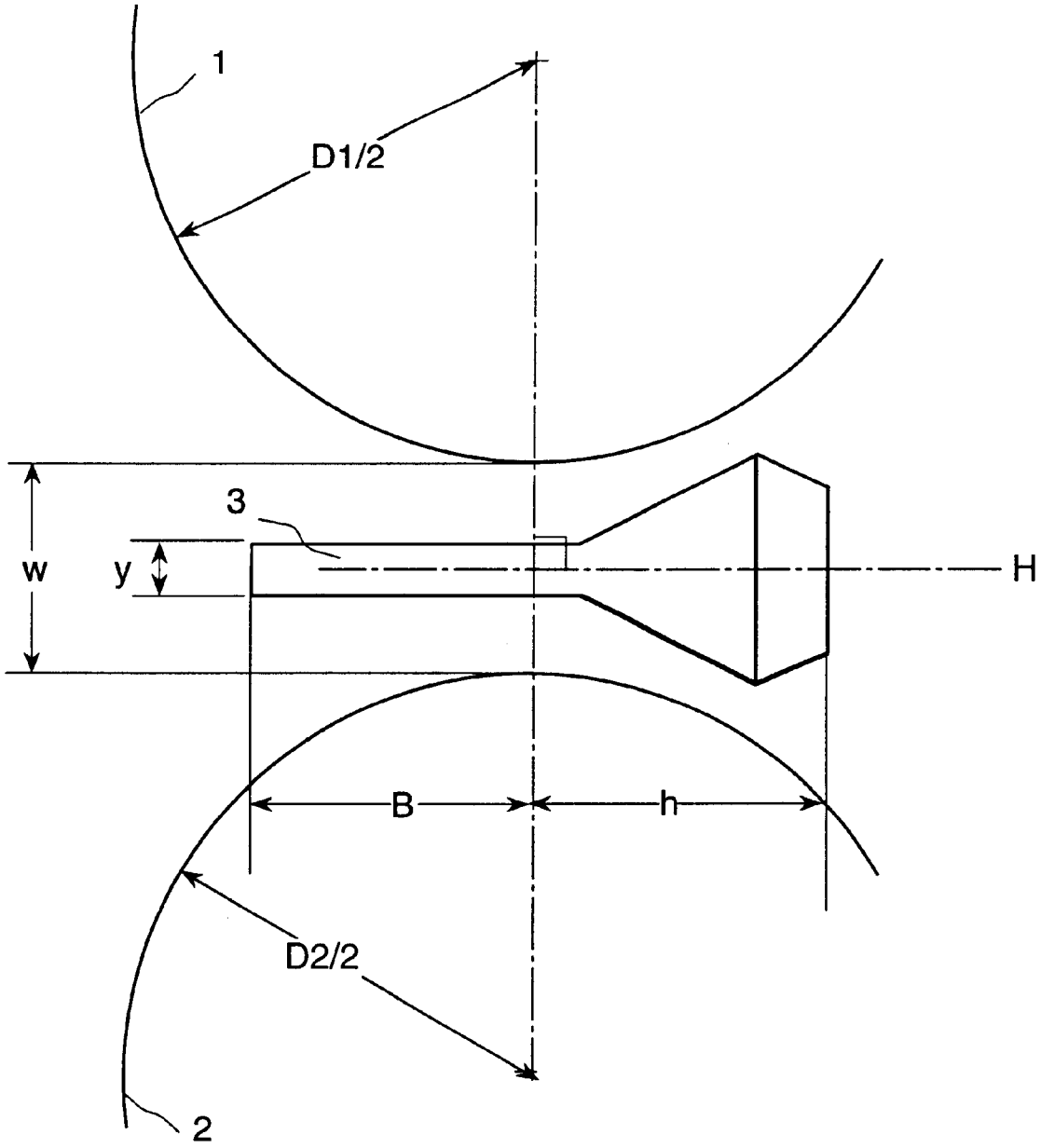
FIG. 18 is a diagram which shows the disposition of the doctor blade.

To prevent the doctor blade 3 from flexing, the doctor blade 3 is improved to have a reinforcing plate 10 of y cm thickness, as illustrated in FIG. 15(*b*). As a result, the doctor blade 3 becomes longer itself. In this embodiment, the width of said doctor gap y is 0.2 cm considering that the distance W between the developing rollers 1 and 2 is 7 cm and the layer of developing agent on respective developing rollers 1 and 2 is 0.2 cm to 0.3 cm thick. As illustrated in FIG. 17, the doctor blade 3 is placed so that the distance between the front (leftmost) end of doctor blade 3 and the surface of the photoconductive drum 101 (of radius r) may be equal to the distance Gdev (developing gap) between the surface of the photoconductive drum 101 and the surface of respective developing rollers 1 and 2. In this configuration, the length B of the reinforcing plate of the doctor blade 3 on the left side of the line segment connecting the central axes of the developing rollers 1 and 2 is expressed by the formula (6) in FIG. 17. The length of the remaining part of the doctor blade 3 (on the right side of the line segment) is obtained from the formula (1), considering the positional relationship with the polarity reversing intersection F.

With this configuration, the length x of the doctor blade 3 is 2.3 cm and the flexure "δ", and the movement ΔG of the doctor gap are respectively δ=0.004 cm and ΔG=0.002 cm when the doctor blade 3 is made of aluminum, or δ=0.002 cm and ΔG=0.001 cm when the doctor blade 3 is made of stainless steel (SUS). It is apparent that this configuration has no influence on the quality of the printed image. However, with this configuration, a pile of toner 41 separated from the developing agent can be found on the upper surface of the reinforcing plate of the doctor blade 3 as printing advances (as illustrated in FIG. 17). This pile of toner 41 is not desirable because it may fall onto the surface of the photoconductive drum 101 and stain the printed images.

To prevent this unwanted toner pile, the configuration is changed so that the developing agent on the developing roller 1 may touch the doctor blade 3 and always clean the upper surface of the reinforcing plate of the doctor blade 3. Substantially, the width y of said doctor gap is made 0.3 cm when the distance W between the developing rollers 1 and 2 is 7 cm and the height of the layer of the developing agent of the respective developing rollers is 0.2 cm to 0.3 cm.

This configuration has no influence on the quality of the printed image (δ=0.005 cm and ΔG=0.003 cm when the doctor blade 3 is made of aluminum or δ=0.002 cm and ΔG=0.001 cm when the doctor blade 3 is made of stainless steel (SUS)), and no pile of toner appears on the reinforcing plate of the doctor blade 3.

By applying a doctor blade 3 having this configuration to a developing system in which developing rollers 1 and 2 having diameters D1 and D2 of 5 cm are separated by 1.3 cm (distance W between the rollers), we checked the angles θ1 and θ2 (angle made by a line segment connecting the polarity reversing position E1 (E2) and the central axis of the developing roller 1 and the line segment connecting the central axes of the developing rollers 1 and 2) and the length x of the doctor blade 3, which is adjustable in the positional relationship with the polarity reversing intersection F.

As a result, we found that the length x of the doctor blade must be 1.5 cm to 2.6 cm and the angles θ1 and θ2 must be at least less than 40 degrees when the developing rollers 1 and 2 are 5 cm in diameter regardless of whether the doctor blade is made of stainless steel (SUS) or aluminum.

Further, when the developing rollers 1 and 2 are 3 cm in diameter and the doctor blade is made of stainless steel (SUS), we found that the length x of the doctor blade must be 0.9 cm to 2.1 cm and the angles θ1 and θ2 must be at least less than 40 degrees. Similarly, when the developing rollers 1 and 2 are 3 cm in diameter and the doctor blade is made of aluminum, we found that the length x of the doctor blade must be 1.6 cm to 2.1 cm and the angles θ1 and θ2 must be between 20 and 40 degrees.

Furthermore, when the developing rollers 1 and 2 are 2 cm in diameter and the doctor blade is made of stainless steel (SUS), we found that the length x of the doctor blade must be 1.0 cm to 1.8 cm and the angles θ1 and 62 must be between 20 and 40 degrees. However, when the doctor blade is made of aluminum, we could not find any optimum x, θ1, and θ2 values.

Judging from these results of measurement, to make the developing system smaller using smaller developing rollers, we recommend 1.0 cm to 2.1 cm as the length x of the doctor blade, 20 degrees to 40 degrees as the angles θ1 and θ2, and stainless steel (SUS) of Young's modulus of $10^{11}$ $N/m^2$ as the material of the doctor blade.

Printing was carried out with reference to the foregoing considerations under the following conditions:

Using a developing system illustrated in FIG. 1 to FIG. 14.

Using a negatively-charged OPC as said photoconductive drum 101.

Applying −50V to the image area on the surface of the photoconductive drum 101, −600V to the non-image area, and a bias potential of 300V to the developing rollers 1 and 2.

Rotating the photoconductive drum 101 at a circumferential speed of 30 cm/second and the developing rollers 1 and 2 at a ratio of circumferential speed (relative to the photoconductive drum 101) of 1.9.

Setting a clearance (distance) of 0.1 cm between the photoconductive drum 101 and respective developing rollers 1 and 2, a true density of the carrier of 5 grams/cm$^3$, and a weight ratio (in percentage) of the toner in the developing agent of 2.5%.

As a result, we could obtain high-quality printed images which were uniform, 1.3 or more of the reflection density of a solid image, and free from image quality difference in the longitudinal direction of the doctor blade and faints at the longitudinal ends of the doctor blade.

Figure 19:
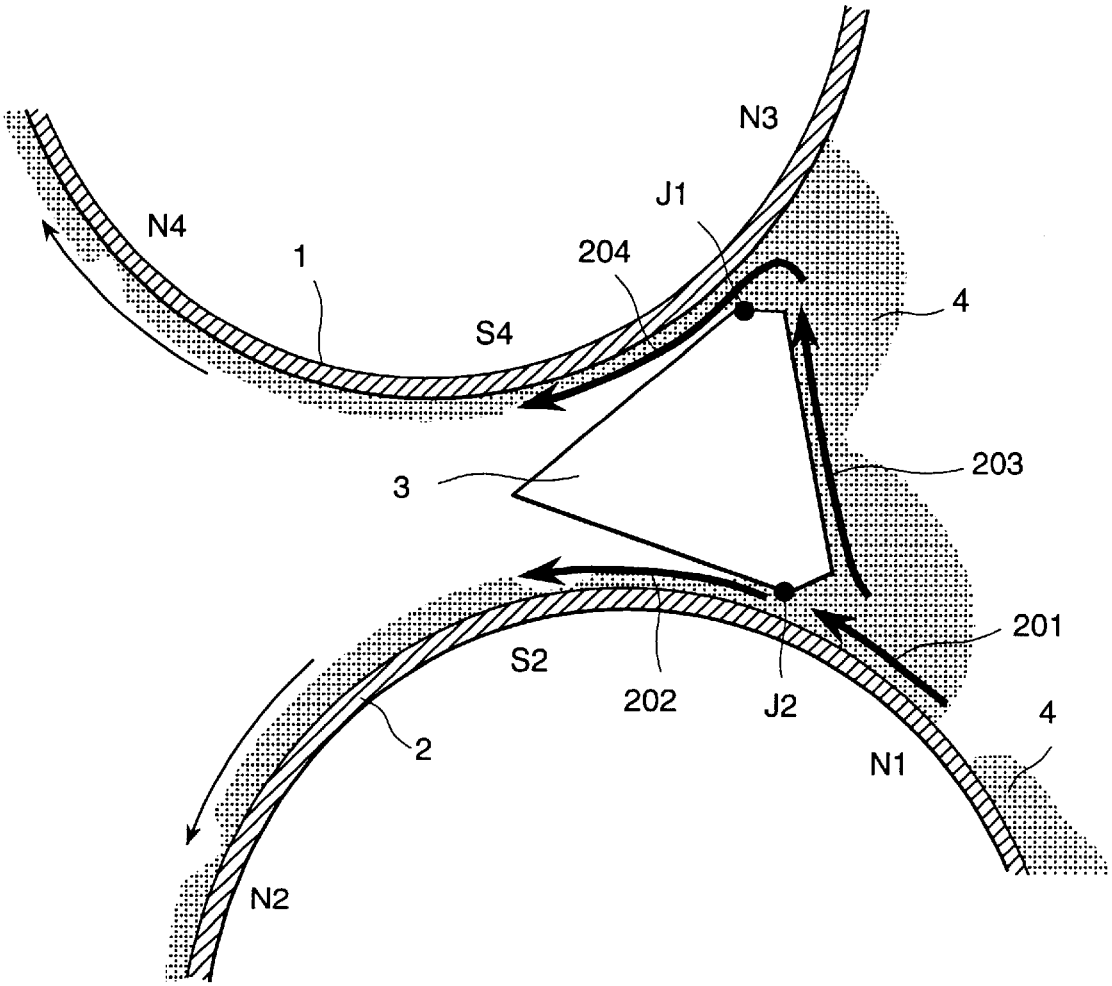
FIG. 19 is a diagram which shows the flow of the developing agent in the vicinity of the doctor blade.

Another embodiment of the present invention will be explained below with reference to FIG. 19, which diagrammatically explains the flow of developing agent near the doctor blade.

The developing agent 4 transferred from the transfer means 6 is conveyed on the developing roller 2 from the S1 pole position to the N1 pole position, and then is conveyed to the J2 position of the doctor blade 3 (toward the S2) in the arrow direction as the developing roller 2 rotates. At the J2 position, part of the developing agent is conveyed through the clearance between the doctor blade (J2) and the developing roller 2 (as illustrated by the arrow 202) and the developing agent is guided up to the developing roller 1 along the upstream side of the doctor blade (as illustrated by the arrow 203).

In this case, since in this embodiment the doctor blade 3 is located on the upstream side of the developing agent flow (away from the line connecting the central axes of the developing rollers 1 and 2), the space for diverting the developing agent flow between the developing rollers 1 and 2 becomes wider. In addition to this, as the rightmost side of the doctor blade 3 is placed approximately in parallel with the line segment connecting the axes of the developing rollers 1 and 2, the path for the diverted developing agent flow can be made wider. With this mechanism, the developing agent will never stagnate in a small space on the upstream side, which reduces the blocking stress exerted on the developing agent and makes the service life of the developing agent longer.

Although the developing agent flowing in the direction of the arrow 202 (along the surface of the developing roller 2) is conveyed at a constant speed due to the rotation of the developing roller 2, the developing agent flowing in the direction of arrow 203 moves slower as it moves up away from the developing roller 2 due to the influence of gravity and the friction against the rightmost side (upstream side) of the doctor blade 3. In extreme cases, if the developing agent must travel a long distance in the arrow direction 203, or if the rightmost side (upstream side) of the doctor blade 3 is too long, the developing agent cannot get to the developing roller 1.

If the rightmost side (upstream side) of the doctor blade 3 is longer than 15 mm when the circumferential speed of the respective developing rollers 1 and 2 is 660 mm/sec, we found that the quantity of developing agent reaching the developing roller 1 is not constant. Therefore, this embodiment uses 10 mm as the length of the rightmost side (upstream side) of the doctor blade 3.

The developing agent conveyed to the vicinity of the developing roller 1 in the arrow direction 203 is attracted to the surface of the developing roller 1 by the magnetic force of the developing roller 1. Although the movement of the developing agent at this point is slowest, it is accelerated again by the rotational force of the developing roller I in the direction of arrow 204.

As explained above, the speed of the developing agent passing by the J1 point of the doctor blade 3 is a little slower than the speed of the developing agent passing by the J2 point of the doctor blade, although it is re-accelerated by the rotation of the developing roller 1. Therefore, the force of the developing agent passing by the J1 point is smaller than the force of the developing agent passing by the J2 point and, consequently, the quantity of the developing agent passing by the J2 point is less than the quantity of the developing agent passing by the J1 point.

From our experiences, we have known that the quantity of developing agent fed to the forward-rotating developing roller should be equal to that of developing agent fed to the backward-rotating developing roller to get high quality printed images in a developing system using a set of forward-rotating and backward-rotating developing rollers. Therefore, this embodiment makes the doctor gap G1 formed between the doctor blade 3 and the developing roller 1 greater than the doctor gap G2 formed between the doctor blade 3 and the developing roller 2 (as illustrated in FIG. 1) to equalize the respective quantities of developing agent which pass by the J1 and J2 points.

Using the above configuration, printing was carried out under the following conditions:

Using a negatively-charged OPC as said photoconductive drum 101.

Applying −50V to the image area on the surface of the photoconductive drum 101, −600V to the non-image area, and a bias potential of 300V to the developing rollers 1 and 2.

Rotating the photoconductive drum 101 at a circumferential speed of 300 mm/second and the developing rollers 1 and 2 at the ratio of circumferential speed (relative to the photoconductive drum 101) of 2.1.

Setting a clearance (distance) of 0.8 mm between the photoconductive drum 101 and respective developing rollers 1 and 2, a doctor gap G2 of 0.6 mm, a doctor gap G2 of 0.7 mm, and a weight ratio (in percentage) of toner in the developing agent of 2.5%.

As a result, we could obtain high-quality printed images which were uniform, 1.3 or more of the reflection density of solid image, and free from faints at the longitudinal ends of the doctor blade for a long time period.

A developing system according to the present invention which has a doctor blade between two developing rollers can always supply a steady quantity of developing agent to the developing rollers for high-quality printed images.

What is claimed is:

1. A developing system comprising:

an image carrier which is supported for movement in a predetermined moving direction;

a first developing roller comprises a first rotatable sleeve for transporting an image-developing agent in a direction opposite to the moving direction of said image carrier into a region facing a surface of said image carrier, and a first stationary magnet device which is disposed in said first rotatable sleeve;

a second developing roller comprises a second rotatable sleeve for transporting an image-developing agent in the same direction as the moving direction of said image carrier into a region facing the surface of said image carrier, and a second stationary magnet device which is disposed in said second rotatable sleeve; and a parting plate including first and second portions for respectively regulating the quantity of the image-developing agent to be supplied to each of said first and second rotatable sleeves, said first and second portions of said parting plate being disposed at a position on an upstream side in the rotating direction of said first and second rotatable sleeves with respect to the position of closest approach of said first developing roller and said second developing roller, said first and second portions of said parting plate including a part delimiting initiation of a smallest clearance between said parting plate and a respective one of said first and second developing rollers on the upstream side in the rotating direction of said first and second rotatable sleeves, and said parting plate includes a third portion extending in the upstream side from said part of said first and second portions of said parting plate wherein:

(a) said first stationary magnet device includes a first N-pole and a first S-pole disposed adjacent to said first N-pole so that a first polarity reversing point is produced between said first N-pole and said first S-pole in clole proximity to said parting plate, one of said first N-pole and said first S-pole being disposed at least one of on and adjacent to a straight line connecting the central axis of the first and second developing rollers and the other of said first N-pole and said first S-pole being disposed on the upstream side of said one of said first N-pole and said first S-pole;

(b) said second stationary magnet device includes a second N-pole disposed opposite to said first N-pole provided in said first developing roller, a second S-pole disposed adjacent to said second N-pole and opposite to said first S-pole provided in said first developing roller so that a second polarity reversing point is produced between said second N-pole and said second S-pole in close proximity to said parting plate, one of said second N-pole and said second S-pole being disposed at least one of on and adjacent to a straight line connecting the central axis of the first and second developing rollers and the other of said second N-pole and said second S-pole being disposed on the upstream side of said one of said second N-pole and said second S-pole; and (c) an intersection point where the extension of a straight line connecting the central axis of said first developing roller and said first polarity reversing point meets the extension of a straight line connecting the central axis of said second developing roller and said second polarity reversing point is positioned on the upstream side of said first and second portions of said parting plate in the rotating direction of said first and second developing rollers.

2. A developing system according to claim wherein each of an angle θ1, which is formed by a straight line connecting the central axes of said first developing roller and said second developing roller and a straight line connecting the central axis of said first developing roller and said intersection point, and an angle θ2, which is formed by the straight line connecting the central axes of said first developing roller and said second developing roller and a straight line connecting the central axis of said second developing roller and said intersection point, is set to a value not larger than 50 degrees.

3. A developing system according to claim 1, wherein said parting plate is equipped with a projecting portion projecting toward a downstream side, in the rotating direction, of said first and second developing rollers.

4. A developing system according to claim 3, wherein at least an upper surface of said projecting portion is arranged so as to be in contact with the image-developing agent conveyed by said first developing roller.

5. A developing system according to claim 3, wherein a distance (B) from an end of said projecting portion to a straight line connecting the central axes of said first developing roller and said second developing roller is set to a value smaller than ½ of a radius of at least one of said first and second developing rollers.

6. A developing system according to claim 1, wherein said parting plate is made of a material whose Young's modulus is larger than $10^{11}$ ($N/M^2$).

7. A developing system according to claim 1, wherein a minimum size of a clearance formed between said first developing roller and said parting plate is set to a value larger than a minimum size of a clearance formed between said second developing roller and said parting plate.

8. A developing system according to claim 1, wherein said intersection point is equidistant from the centers of said first and second developing rollers.

9. A developing system according to claim 1, wherein said intersection point is non-equidistant from the centers of said first and second developing rollers.

10. A developing system according to claim 1, wherein said parting plate includes at least another portion thereof which is disposed one of at a position proximate to the position of closest approach of said first developing roller and said second developing roller and at a position at a downstream side with respect to the position of closest approach.

11. A developing system according to claim 1, wherein the intersection point is positioned upstream of a straight line connecting said part of said first and second portions of said parting plate delimiting the smallest clearance between said parting plate and a respective one of said first and second developing rollers.

12. A developing system comprising:

an image carrier which is supported for movement in a predetermined moving direction;

a first developing roller comprises a first rotatable sleeve for transporting an image-developing agent in a direction opposite to the moving direction of said image carrier into a region facing a surface of said image carrier, and a first stationary magnet device which is disposed in said first rotatable sleeve;

a second developing roller comprises a second rotatable sleeve for transporting an image-developing agent in the same direction as the moving direction of said image carrier into a region facing the surface of said image carrier, and a second stationary magnet device which is disposed in said second rotatable sleeve;

a parting plate for regulating the quantity of the image-developing agent to be supplied to each of said first and second rotatable sleeves, said parting plate being disposed at a position on an upstream side in the rotating direction of said first and second rotatable sleeves with respect to the position of closest approach of said first developing roller and said second developing roller; and a member for supplying the image-developing agent to said second developing roller;

wherein:

(a) said first stationary magnet means includes a first N-pole and a first S-pole disposed adjacent to said first N-pole so that a first polarity reversing point is produced between said first N-pole and said first S-pole in close proximity to said parting plate;

(b) said second stationary magnet means includes a second N-pole disposed opposite to said first N-pole provided in said first developing roller, a second S-pole disposed adjacent to said second N-pole and opposite to said first S-pole provided in said first developing roller so that a second polarity reversing point is produced between said second N-pole and said second S-pole in close proximity to said parting plate; and (c) an intersection point where the extension of a straight line connecting the central axis of said first developing roller and said first polarity reversing point meets the extension of a straight line connecting the central axis of said second developing roller and said second polarity reversing point is positioned on the upstream side of said parting plate in the rotating direction of said first and second developing rollers; and (d) a distance (L) between said intersection point and an outer peripheral surface of said second developing roller is set to a value smaller than a distance (Z) between said member for supplying the image-developing agent to said second developing roller and the outer peripheral surface of said second developing roller.

13. A developing system according to claim 12, wherein said distance (Z) is set to a value larger than 1.5 times said distance (L).

14. A developing system comprising:

an image carrier which is supported for movement in a predetermined moving direction;

a first developing roller comprises a first rotatable sleeve for transporting an image-developing agent in a direction opposite to the moving direction of said image carrier into a region facing a surface of said image carrier, and a first stationary magnet means which is disposed in said first rotatable sleeve;

a second developing roller comprises a second rotatable sleeve for transporting an image-developing agent in the same direction as the moving direction of said image carrier into a region facing the surface of said image carrier, and a second stationary magnet means which is disposed in said second rotatable sleeve; and a parting plate for regulating the quantity of the image-developing agent to be supplied to each of said first and second rotatable sleeves, said parting plate being disposed at a position on an upstream side in the rotating direction of said first and second rotatable sleeves with respect to the position of closest approach of said first developing roller and said second developing roller; and a member for supplying the image-developing agent to said second developing roller;

wherein:

(a) said first stationary magnet means includes a first N-pole and a first S-pole disposed adjacent to said first N-pole so that a first polarity reversing point is produced between said first N-pole and said first S-pole in close proximity to said parting plate;

(b) said second stationary magnet means includes a second N-pole disposed opposite to said first N-pole provided in said first developing roller, a second S-pole disposed adjacent to said second N-pole and opposite to said first S-pole provided in said first developing roller so that a second polarity reversing point is produced between said second N-pole and said second S-pole in close proximity to said parting plate; and (c) an intersection point where the extension of a straight line connecting the central axis of said first developing roller and said first polarity reversing point meets the extension of a straight line connecting the central axis of said second developing roller and said second polarity reversing point is positioned on the upstream side of said parting plate in the rotating direction of said first and second developing rollers; and (d) an auxiliary member for regulating a quantity of the image-developing agent reaching said second developing roller is provided near a transfer path of the image-developing agent between said second developing roller and said member for supplying the image-developing agent to said second developing roller.

* * * * *